US012180557B2

(12) United States Patent
Yabu et al.

(10) Patent No.: US 12,180,557 B2
(45) Date of Patent: Dec. 31, 2024

(54) COLD ROLLED STEEL SHEET AND METHOD FOR PRODUCING SAME

(71) Applicant: NIPPON STEEL CORPORATION, Tokyo (JP)

(72) Inventors: Shohei Yabu, Tokyo (JP); Koutarou Hayashi, Tokyo (JP); Akihiro Uenishi, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 656 days.

(21) Appl. No.: 17/434,986

(22) PCT Filed: Mar. 31, 2020

(86) PCT No.: PCT/JP2020/014924

§ 371 (c)(1),
(2) Date: Aug. 30, 2021

(87) PCT Pub. No.: WO2020/209149

PCT Pub. Date: Oct. 15, 2020

(65) Prior Publication Data

US 2022/0145415 A1 May 12, 2022

(30) Foreign Application Priority Data

Apr. 8, 2019 (JP) ..... 2019-073705

(51) Int. Cl.
*C21D 8/02* (2006.01)
*C21D 9/46* (2006.01)
(Continued)

(52) U.S. Cl.
CPC ..... *C21D 8/0236* (2013.01); *C21D 8/0226* (2013.01); *C21D 8/0263* (2013.01);
(Continued)

(58) Field of Classification Search
None
See application file for complete search history.

(56) References Cited

U.S. PATENT DOCUMENTS

2014/0238557 A1 8/2014 Haga et al.
2018/0127856 A1 5/2018 Takashima et al.
(Continued)

FOREIGN PATENT DOCUMENTS

CN 108474074 A 8/2018
JP S8-39736 A 3/1983
(Continued)

OTHER PUBLICATIONS

Machine translation of JP 2013-032582A. (Year: 2013).*

*Primary Examiner* — Xiaowei Su
(74) *Attorney, Agent, or Firm* — Birch, Stewart, Kolasch & Birch, LLP

(57) ABSTRACT

The present invention relates to a cold rolled steel sheet containing C: 0.15% or more and 0.40% or less, Si: 0.50% or more and 4.00% or less, Mn: 1.00% or more and 4.00% or less, and sol. Al: 0.001% or more and 2.000% or less, having a metallic structure consisting of 35 to 65 area % of ferrite phases, 35 to 65 area % of hard second phases, and 0 to 5 area % of remaining phases, wherein 60% or more of the ferrite phases are recrystallized ferrite phases, an average crystal grain size defined by 15° grain boundaries is 5.0 μm or less, a maximum connecting rate of the hard second phases is 10% or more, and a two-dimensional isoperimetric constant of the hard second phases is 0.20 or less.

10 Claims, 1 Drawing Sheet

(51) Int. Cl.

| | |
|---|---|
| ***C22C 38/02*** | (2006.01) |
| ***C22C 38/04*** | (2006.01) |
| ***C22C 38/06*** | (2006.01) |
| ***C23C 2/02*** | (2006.01) |
| ***C23C 2/06*** | (2006.01) |
| ***C23C 2/28*** | (2006.01) |
| ***C23C 2/40*** | (2006.01) |

(52) U.S. Cl.

CPC ..... *C21D 8/0273* (2013.01); *C21D 9/46* (2013.01); *C22C 38/02* (2013.01); *C22C 38/04* (2013.01); *C22C 38/06* (2013.01); *C23C 2/02* (2013.01); *C23C 2/0224* (2022.08); *C23C 2/024* (2022.08); *C23C 2/06* (2013.01); *C23C 2/28* (2013.01); *C23C 2/40* (2013.01); *C21D 2211/001* (2013.01); *C21D 2211/002* (2013.01); *C21D 2211/003* (2013.01); *C21D 2211/005* (2013.01); *C21D 2211/008* (2013.01)

(56) References Cited

U.S. PATENT DOCUMENTS

| | | | | |
|---|---|---|---|---|
| 2019/0032186 | A1 | 1/2019 | Ueno et al. | |
| 2019/0144966 | A1 * | 5/2019 | Yabu ..... | C22C 38/12 420/83 |

FOREIGN PATENT DOCUMENTS

| | | | | |
|---|---|---|---|---|
| JP | 2011-111671 | A | 6/2011 | |
| JP | 4964494 | B2 | 6/2012 | |
| JP | 2013-14824 | A | 1/2013 | |
| JP | 2013-32582 | A | 2/2013 | |
| JP | 2014-65975 | A | 4/2014 | |
| JP | 2017-66453 | A | 4/2017 | |
| WO | WO 2016/135794 | A1 | 9/2016 | |
| WO | WO-2018030400 | A1 * | 2/2018 | ..... C21D 6/005 |

* cited by examiner

COLD ROLLED STEEL SHEET AND METHOD FOR PRODUCING SAME

FIELD

The present invention relates to a cold rolled steel sheet and a method for producing the same. More particularly, it relates to a cold rolled steel sheet excellent in shape fixability and workability and a method for producing the same.

BACKGROUND

Improvement of the fuel efficiency of automobiles and securing safety in collision have been simultaneously sought. Steel sheet for automotive use has been made lighter in weight and higher in strength. Therefore, as steel sheet for automotive use, high strength steel sheet having higher tensile strength has been used in large amounts.

Further, steel sheet for automotive use is mostly shaped by press-forming, and therefore the high strength steel sheet used for steel sheet for automotive use is required to have excellent workability. To secure excellent workability, uniform elongation enabling shaping without cracking at the time of shaping is sought. Furthermore, in high strength steel sheet, shape fixability is sought for forming it into the shape of the targeted part with a high dimensional precision.

In particular, in recent years, there has been rising demand for lightening the weight of automobiles. In high strength steel, for example, high strength steel having a tensile strength of 1180 MPa or more, steel sheet having the above such excellent shape fixability and workability is required.

However, along with the higher strength of steel sheet, it has become difficult to sufficiently secure ductility which is in a tradeoff relationship with strength. Further, if steel sheet becomes higher in strength, the problem arises that the amount of springback at the time of press-forming becomes greater and it becomes difficult to form the steel sheet into a shape of the targeted part with a high dimensional precision. "Springback" means the phenomenon where when steel sheet is press-formed by a die, the bent part receiving the bending moment in the constrained state deforms when detached from the die so that the moment becomes smaller and deviation occurs in the shape of the press-formed steel sheet from the die shape. Such springback becomes more remarkably the higher the strength of steel sheet and becomes a problem in press-forming. To suppress springback, it is effective to decrease the yield ratio (yield point/tensile strength), and therefore in high strength steel sheet used for portions where high dimensional precision is sought, a low yield ratio is strongly demanded.

To deal with such a problem, PTL 1 describes a method for producing a composite structure type high strength cold rolled steel sheet. Specifically, PTL 1 discloses a method for producing a composite structure type high strength cold rolled steel sheet comprising hot rolling and cold rolling a steel containing C: 0.003 to 0.03%, Si: 0.1 to 1%, Mn: 0.3 to 1.5%, Ti: 0.02 to 0.2%, Al: 0.01 to 0.07% and having (Si %+2·Mn %)=1 to 3% and an (effective Ti)/(C+N) atomic concentration ratio of 0.4 to 0.8, then continuously annealing it by heating it to a temperature of the Ac1 transformation point or more and 900° C. or less for 30 seconds to 10 minutes and cooling it by a cooling rate of 30° C./s or more. PTL 1 teaches that by this production method, steel sheet having composite structures comprised of ferrite and second phases of martensite and/or bainite is obtained and that this steel sheet is steel sheet having a r-value of 1.4 or more and a yield ratio of 50% or less and excellent in balance of tensile strength-elongation.

On the other hand, PTL 2 discloses a cold rolled steel sheet having a chemical composition containing C: 0.01% or more and 0.15% or less, Si: 0.01% or more and 1.5% or less, Mn: 1.5% or more and 3.5% or less, P: 0.1% or less, S: 0.01% or less, Al: more than 0.10% and 1.5% or less, and N: 0.010% or less and having an α-value prescribed by $\alpha$=Mn+Si×0.5+Al×0.4 of 1.9 or more, and steel structures having a ferrite volume ratio of 40% or more and a martensite volume ratio of 3% or more at a position of ¼ depth of the sheet thickness from the surface of the steel sheet. Further, PTL 2 teaches that the cold rolled steel sheet has composite structures of ferrite and martensite having excellent mechanical properties by making the average crystal grain size $d_F$ (μm) of the ferrite at the position of ¼ depth of the sheet thickness finer to 4.5 μm or less.

However, in the art described in PTL 1, the content of C is small and it is difficult to obtain high strength steel having a high tensile strength such as 1180 MPa or more. On the other hand, by just the refining of the average crystal grain size of ferrite such as described in PTL 2, it is difficult to maintain a high tensile strength while reducing the yield ratio.

In general, as a technique for realizing higher tensile strength, strengthening of the microstructure using martensite or tempered martensite has been known. However, if using martensite or tempered martensite, while the strength is high, the uniform elongation is extremely low and good workability is difficult to secure. Further, with single phases of martensite, it is difficult to reduce the yield ratio and difficult to secure shape fixability as well.

As high strength steel sheet for solving this problem, a composite structure steel sheet comprised of soft phases (ferrite) and hard phases (martensite and tempered martensite) may be considered. In composite structure steel sheet, ductility is secured by the soft phases and strength is secured by the hard phases. Further, due to the difference in strengths between the soft and hard phases, the yield phenomenon occurs earlier at the soft phase side, and therefore it is possible to greatly reduce the yield point. However, in such composite structure steel sheet, to secure a higher tensile strength of the steel sheet, it is necessary to sufficiently raise the volume ratio of the hard phases. If making the volume ratio of the hard phases increase, in the prior art, a drop in the uniform elongation and increase in the yield ratio are unavoidable, and therefore in the high strength class such as 1180 MPa or more, there was the problem that realization of excellent uniform elongation and a low yield ratio was extremely difficult.

PTL 3 proposes a steel sheet comprising a steel sheet microstructure mainly comprised of ferrite and including martensite, having a volume ratio of ferrite of 60% or more, having a block size of martensite of 1 μm or less, and having a concentration of C in the martensite of 0.3% to 0.9%, whereby the strength of the martensite structures is raised without increasing the volume ratio of the hard structures of martensite and thereby the volume of ferrite contributing to securing ductility is secured while a maximum tensile strength of 900 MPa or more (900 to 1582 MPa) and a yield ratio (YR) of 0.75 or less are secured.

However, in the art shown in PTL 3, the particle sizes of the ferrite and martensite are controlled, but the morphology is not controlled at all. There was still room for improvement in regard to the improvement of the tensile strength and the reduction of the yield ratio.

In relation to a composite structure steel sheet, PTL 4 describes a method for producing a cold rolled steel sheet comprising a metallic structure with main phases comprised of low temperature transformed phases, and second phases including retained austenite and polygonal ferrite, the method comprising (A) a hot rolling step including hot rolling a slab having a chemical composition comprising, by mass %, C: more than 0.020% and less than 0.30%, Si: more than 0.10% and 3.00% or less, Mn: more than 1.00% and 3.50% or less, P: 0.10% or less, S: 0.010% or less, sol. Al: 2.00% or less and N: 0.010% or less, and a balance of Fe and impurities and ending the rolling in a temperature region of the Ara point or more to obtain hot rolled steel sheet, cooling the hot rolled steel sheet down to a temperature region of 780° C. or less within 0.4 second after the end of the rolling, and coiling it in a temperature region of less than 400° C.; (B) a hot rolled sheet annealing step including hot rolled sheet annealing by heating the hot rolled steel sheet obtained in the above step (A) to a temperature region of 300° C. or more to obtain a hot rolled annealed steel sheet; (C) a cold rolling step including cold rolling the hot rolled annealed steel sheet to obtain a cold rolled steel sheet; and (D) an annealing step including soaking the cold rolled steel sheet at a temperature region of ($Ac_3$ point−40° C.) or more, then cooling it to a temperature region of 500° C. or less and 300° C. or more and holding it at the temperature region for 30 seconds or more. Further, PTL 4 describes that according to the above method, it is possible to obtain a high strength cold rolled steel sheet having sufficient ductility, work hardenability, and stretch flangeability enabling it to be applied to press-forming and other working operations.

However, PTL 4 does not necessarily sufficiently study maintaining a high strength while decreasing the yield ratio as a perspective. Therefore, in the invention described in PTL 4, there still has been room for improvement of the shape fixability, etc.

CITATIONS LIST

Patent Literature

[PTL 1] Japanese Unexamined Patent Publication No. 58-39736

[PTL 2] Japanese Unexamined Patent Publication No. 2014-65975

[PTL 3] Japanese Unexamined Patent Publication No. 2011-111671

[PTL 4] Japanese Unexamined Patent Publication No. 2013-14824

SUMMARY

Technical Problem

Therefore, the technical problem to be solved by the present invention is to provide a high strength cold rolled steel sheet excellent in workability and shape fixability having excellent uniform elongation and improved in yield ratio YR by a novel constitution and a method for producing the same.

Solution to Problem

The inventors engaged in intensive research to solve the above problem and produce a high strength cold rolled steel sheet excellent in workability and shape fixability. Below, details of the present art will be explained.

The inventors engaged in intensive studies and as a result discovered that by making the metallic structure of steel sheet a microstructure including soft phases and hard phases and by making the phases uniformly and finely disperse and controlling the morphology to one having interfacial shapes where hard phases and soft phases are intricately intertwined, it is possible to improve the ductility by the soft phases and secure the strength by the hard phases in a complementary manner to the maximum extents. They discovered that by controlling the chemical composition and area ratios of the phases in appropriate ranges and further controlling the recrystallization rates of the soft phases in addition to controlling the particle sizes and morphology of the interfacial shapes of the two phases, a steel sheet having both a 1180 MPa or more tensile strength and excellent uniform elongation and having a yield ratio (YR) of 60% or less can be realized.

The inventors discovered that by integrally controlling the (a) hot rolling step-(b) tempering step-(c) cold rolling step-(d) annealing step, it is possible, in a way not able to be realized in the prior art, to obtain a microstructure in which the soft phases and hard phases are made to uniformly and finely disperse and in which the interfacial shapes of the two phases are controlled to intricately intertwined forms. Specifically, the inventors discovered a method for producing a cold rolled steel sheet excellent in workability and shape fixability comprising (a) a hot rolling step controlling the microstructure to low temperature transformed phases imparting certain accumulated strain (for example, martensite phases), (b) a tempering step causing iron carbides to uniformly and finely precipitate, (c) a cold rolling step imparting driving force for recrystallization of ferrite, and (d) an annealing step for causing ferrite to sufficiently recrystallize during heating and for pinning the recrystallized ferrite grain boundaries by iron carbides and promoting growth of austenite along the grain boundaries to thereby make the soft phases and hard phases uniformly and finely disperse and control the morphology to one where the interfacial shapes of the two phases are intricately intertwined.

The gist of the present invention is as follows:

[1] A cold rolled steel sheet having a chemical composition consisting of, by mass %, C: 0.15% or more and 0.40% or less,
Si: 0.50% or more and 4.00% or less,
Mn: 1.00% or more and 4.00% or less,
sol. Al: 0.001% or more and 2.000% or less,
P: 0.020% or less,
S: 0.020% or less,
N: 0.010% or less,
Ti: 0% or more and 0.200% or less,
Nb: 0% or more and 0.200% or less,
B: 0% or more and 0.010% or less,
V: 0% or more and 1.00% or less,
Cr: 0% or more and 1.00% or less,
Mo: 0% or more and 1.00% or less,
Cu: 0% or more and 1.00% or less,
Co: 0% or more and 1.00% or less,
W: 0% or more and 1.00% or less,
Ni: 0% or more and 1.00% or less,
Ca: 0% or more and 0.010% or less,
Mg: 0% or more and 0.010% or less,
REM: 0% or more and 0.010% or less,
Zr: 0% or more and 0.010% or less, and
balance: iron and impurities, and a metallic structure consisting of ferrite phases, hard second phases consisting of martensite phases and retained austenite phases, and remaining phases consisting of cementite phases and bainite phases, wherein an area ratio of the ferrite phases is 35% or more and 65% or less, an area ratio of the hard second phases is 35% or more and 65% or less, an area ratio of the remaining phases is 0% or more and 5% or less, 60% or more of the ferrite phases are recrystallized ferrite phases, an average crystal grain size defined by 15° grain boundaries is 5.0 μm or less, a maximum connecting rate of the hard second phases is 10% or more, and a two-dimensional isoperimetric constant of the hard second phases is 0.20 or less.

[2] The cold rolled steel sheet according to [1], wherein the chemical composition comprises, by mass %, one or more selected from the group consisting of Ti: 0.001% or more and 0.200% or less,
Nb: 0.001% or more and 0.200% or less,
B: 0.0005% or more and 0.010% or less,
V: 0.005% or more and 1.00% or less,
Cr: 0.005% or more and 1.00% or less,
Mo: 0.005% or more and 1.00% or less,
Cu: 0.005% or more and 1.00% or less,
Co: 0.005% or more and 1.00% or less,
W: 0.005% or more and 1.00% or less,
Ni: 0.005% or more and 1.00% or less,
Ca: 0.0003% or more and 0.010% or less,
Mg: 0.0003% or more and 0.010% or less,
REM: 0.0003% or more and 0.010% or less, and
Zr: 0.0003% or more and 0.010% or less.

[3] The cold rolled steel sheet according to [1] or [2], having a hot dip galvanized layer on the surface thereof.

[4] The cold rolled steel sheet according to [1] or [2], having a hot dip galvannealed layer on the surface thereof.

[5] A method for producing the cold rolled steel sheet according to [1] or [2], comprising:

a hot rolling step of rough rolling a slab having the chemical composition according to [1] or [2], then finish rolling it wherein a rolling reduction of a final stage of the finish rolling is 15% or more and 50% or less and an end temperature of the finish rolling is Ar3° C. or more and 950° C. or less, cooling it down to a coiling temperature of less than 400° C. by an average cooling rate of 50° C./s or more, and coiling it at the coiling temperature, a tempering step of tempering the hot rolled steel sheet in a temperature region of 450° C. or more and less than 600° C. under conditions of a tempering parameter 4 defined by following Formula 1 of 14000 to 18000, a cold rolling step of pickling the tempered steel sheet, then cold rolling it by a rolling reduction of 30% or more, and an annealing step of heating the cold rolled steel sheet in a temperature region of 500° C. to Ac1° C. by an average heating rate of 5.0° C./s or less up to a maximum heating temperature of (Ac1+10)° C. or more and (Ac3−10)° C. or less, holding it at the maximum heating temperature for 60 seconds or more, then cooling it in a temperature region of (Ac1−50)° C. to a cooling stop temperature by an average cooling rate of 20° C./s or more down to the cooling stop temperature of Ms° C. or less:

$$\xi=(T+273)\cdot[\log_{10}(t/3600)+20] \quad \text{Formula 1:}$$

T [° C.]: tempering temperature, t [s]: tempering time $$Ac1\ [°\ C.]=751-16\times[\%\ C]+35\times[\%\ Si]-28\times[\%\ Mn]$$

$$Ac3\ [°\ C.]=881-353\times[\%\ C]+65\times[\%\ Si]-24\times[\%\ Mn]$$

$$Ar3\ [°\ C.]=910-203\times[\%\ C]+44.7\times[\%\ Si]-24\times[\%\ Mn]-50\times[\%\ Ni]$$

$$Ms\ [°\ C.]=521-353\times[\%\ C]-22\times[\%\ Si]-24\times[\%\ Mn]$$

where, % C, % Si, % Mn, and % Ni are contents [mass %] of C, Si, Mn, and Ni.

[6] The method for producing the cold rolled steel sheet according to [5], further comprising cooling down to the cooling stop temperature of Ms° C. or less, then holding at a temperature of 200° C. or more and 450° C. or less for 60 seconds or more and 600 seconds or less.

[7] The method for producing the cold rolled steel sheet according to [5] or [6], further comprising hot dip galvanization at a temperature of 430° C. or more after the annealing step to produce the cold rolled steel sheet according to [3].

[8] The method for producing the cold rolled steel sheet according to [5] or [6], further comprising hot dip galvanization at a temperature of 430° C. or more after the annealing step, then alloying treatment at 400° C. or more and 600° C. or less to produce the cold rolled steel sheet according to [4].

Advantageous Effects of Invention

According to the present invention, it is possible to obtain a high strength cold rolled steel sheet excellent in workability and shape fixability having a tensile strength TS of 1180 MPa or more and excellent uniform elongation and having a yield ratio YR of 60% or less.

DESCRIPTION OF EMBODIMENTS

<Cold Rolled Steel Sheet>

Figure 1:
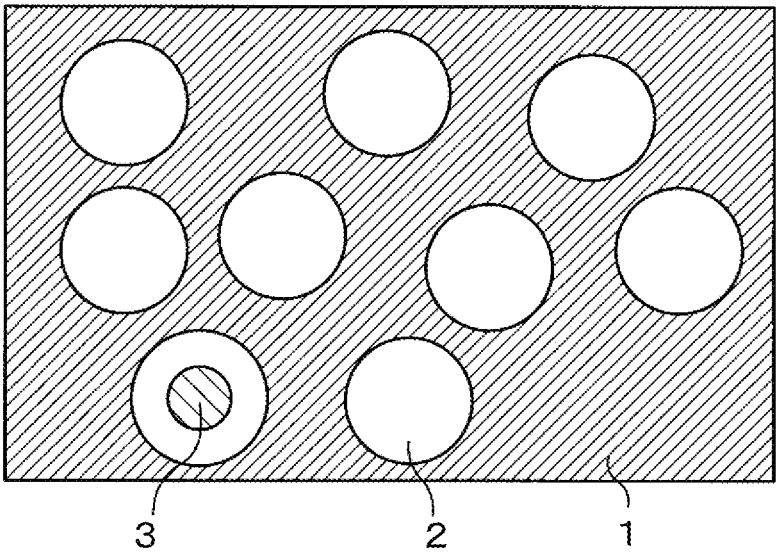
FIG. 1 is a view schematically showing a maximum connected region in a steel sheet microstructure.

Below, a cold rolled steel sheet according to one embodiment of the present invention will be explained in detail. However, the present invention is not limited to only the configuration disclosed in the present embodiment and can be changed in various ways within a range not deviating from the gist of the present invention. Further, the ranges of limitation of the numerical values described below include the lower limit values and upper limit values in those ranges. Numerical values described with "more than" or "less than" are not included in the ranges of the numerical values. The "%" relating to the contents of the elements mean "mass %".

[Chemical Composition]

First, the chemical composition and reasons of limitation of the cold rolled steel sheet according to the present invention will be explained. The cold rolled steel sheet of the present embodiment contains, as its chemical composition, basic elements and, as required, optional elements and has a balance of iron and impurities.

In the chemical composition of the cold rolled steel sheet according to the present embodiment, C, Si, Mn, Al, P, S, and N are the basic elements.

(C: 0.15% or More and 0.40% or Less)

C (carbon) is an element important in securing the strength of the steel sheet. To sufficiently obtain such an effect, the content of C is 0.15% or more, preferably 0.17% or more or 0.20% or more, more preferably 0.23% or more, still more preferably 0.25% or more. On the other hand, if excessively containing C, sometimes the weldability becomes poor. Therefore, the content of C is 0.40% or less, preferably 0.35% or less, more preferably 0.30% or less.

(Si: 0.50% or More and 4.00% or Less)

Si (silicon) is an element important in holding the cementite up to a high temperature. If the content of Si is low, cementite dissolves during the heating and sometimes refining the crystal grains becomes difficult. Therefore, the content of Si is 0.50% or more. Preferably, it is 0.80% or more or 0.90% or more, more preferably 1.00% or more. On the other hand, if excessively containing Si, sometimes deterioration of the surface properties is caused, and therefore the content of Si is 4.00% or less. The content of Si is preferably 3.50% or less or 3.20% or less, more preferably 3.00% or less.

(Mn: 1.00% or More and 4.00% or Less)

Mn (manganese) is an element effective for raising the hardenability of steel sheet. To sufficiently obtain such an effect, the content of Mn is 1.00% or more. The content of Mn is preferably 1.20% or more or 1.50% or more, more preferably 2.00% or more. On the other hand, if excessively adding Mn, due to Mn segregation, sometimes the microstructure becomes heterogeneous and the stretch flangeability falls. Therefore, the Mn content is 4.00% or less, preferably 3.50% or less or 3.00% or less, more preferably 2.80% or less or 2.60% or less.

(Sol. Al: 0.001% or More and 2.000% or Less)

Al (aluminum) is an element having the action of deoxidizing steel and making the steel sheet sounder. To reliably obtain such an effect, the content of sol. Al is 0.001% or more. However, if deoxidation is sufficiently necessary, the content of sol. Al is more preferably 0.010% or more, still more preferably 0.020% or more or 0.025% or more. On the other hand, if the content of sol. Al is too high, sometimes the fall in weldability becomes remarkable, the oxide-based inclusions increase, and the deterioration of the surface properties becomes remarkable. Therefore, the content of sol. Al is 2.000% or less, preferably 1.500% or less, more preferably 1.000% or less, most preferably 0.800% or less or 0.600% or less. "sol. Al" means soluble Al which is not $Al_2O_3$ or another oxide and can dissolve in acid.

(P: 0.020% or Less)

P (phosphorus) is an impurity generally contained in steel. If the content of P is excessive, the deterioration in the weldability becomes remarkable. Therefore, the content of P is 0.020% or less. The content of P is preferably 0.015% or less or 0.010% or less. The lower limit of the content of P is not particularly limited and may even be 0%, but from the viewpoint of the producing costs, the content of P may be more than 0%, 0.0001% or more, or 0.001% or more.

(S: 0.020% or Less)

S (sulfur) is an impurity generally contained in steel. From the viewpoint of weldability, the less, the better. If the content of S is excessive, the drop in weldability becomes remarkable and the amount of precipitation of MnS increases resulting in a drop in the bendability and other workability. Therefore, the content of S is 0.020% or less. The content of S is preferably 0.010% or less, more preferably 0.005% or less. The content of S may even be 0%, but from the viewpoint of the desulfurization costs, the content of S may be more than 0%, 0.0001% or more, or 0.001% or more.

(N: 0.010% or Less)

N (nitrogen) is an impurity generally contained in steel. From the viewpoint of weldability, the less, the better. If the content of N is excessive, the drop in weldability becomes remarkable. Therefore, the content of N is 0.010% or less. The content of N is preferably 0.005% or less, more preferably 0.003% or less. The content of N may even be 0%, but from the viewpoint of the producing costs, the content of N may be more than 0%, 0.0001% or more, or 0.001% or more.

The cold rolled steel sheet according to the present embodiment may contain the following optional elements in addition to the basic elements explained above. For example, instead of part of the balance of Fe explained above, as optional elements, one or more of Ti, Nb, B, V, Cr, Mo, Cu, Co, W, Ni, Ca, Mg, REM, and Zr may be contained. These optional elements may be contained in accordance with the objective. Accordingly, there is no need to specify lower limit values of these optional elements. The lower limit values may also be 0%. Further, even if the selective elements are contained as impurities, the effects of the present embodiment are not impaired.

(Ti: 0% or More and 0.200% or Less)

Ti (titanium) is an element precipitating as TiC during the cooling of steel sheet and contributing to improvement of the strength. Therefore, Ti may be contained. On the other hand, if excessively adding Ti, this becomes a cause of worse low temperature embrittlement of the steel sheet. Therefore, the content of Ti is 0.200% or less. The content of Ti is preferably 0.180% or less, more preferably 0.150% or less. To reliably obtain this effect, the content of Ti may be 0.001% or more. The content of Ti is preferably 0.020% or more, more preferably 0.050% or more.

(Nb: 0% or More and 0.200% or Less)

Nb (niobium), like Ti, is an element which precipitates as NbC and improves the strength. Therefore, Nb may also be included. On the other hand, if excessively containing Nb, texture develops and the anisotropy of the material sometimes becomes greater. Therefore, the content of Nb is 0.200% or less. The content of Nb is preferably 0.150% or less, more preferably 0.100% or less. To reliably obtain this effect, the content of Nb may be 0.001% or more. The content of Nb is preferably 0.005% or more, more preferably 0.010% or more.

The cold rolled steel sheet according to the present embodiment preferably includes, as its chemical composition, by mass %, at least one of the elements among Ti: 0.001% or more and 0.200% or less and Nb: 0.001% or more and 0.200% or less.

(B: 0% or More and 0.010% or Less)

B (boron) segregates at the grain boundaries to improve the intergranular strength and thereby can improve the toughness of the material. Therefore, B may also be included. On the other hand, even if the content of B is too high, the above effect becomes saturated and economically disadvantageous, so the upper limit of the content of B is 0.010%. The content of B is preferably 0.005% or less, more preferably 0.003% or less. To reliably obtain this effect, the content of B may be 0.0005% or more or 0.001% or more.

(V: 0% or more and 1.00% or less)

(Cr: 0% or more and 1.00% or less)

(Mo: 0% or more and 1.00% or less)

(Cu: 0% or more and 1.00% or less)

(Co: 0% or more and 1.00% or less)

(W: 0% or more and 1.00% or less)

(Ni: 0% or more and 1.00% or less)

V (vanadium), Cr (chromium), Mo (molybdenum), Cu (copper), Co (cobalt), W (tungsten), and Ni (nickel) are all elements for stably securing strength. Therefore, these elements may also be contained. However, even if one of these elements is contained in excess, the effect due to the above action becomes easily saturated and sometimes economically disadvantageous. Therefore, the contents of these elements are respectively 1.00% or less. The contents of these elements are respectively preferably 0.80% or less, more preferably 0.50% or less. To more reliably obtain the effect according to the above action, for any of the elements, the content need only be 0.005% or more, preferably 0.01% or more, more preferably 0.05% or more.

In the cold rolled steel sheet according to the present embodiment, as the chemical composition, by mass %, at least one type of element among V: 0.005% or more and 1.00% or less, Cr: 0.005% or more and 1.00% or less, Mo: 0.005% or more and 1.00% or less, Cu: 0.005% or more and 1.00% or less, Co: 0.005% or more and 1.00% or less, W: 0.005% or more and 1.00% or less, and Ni: 0.005% or more and 1.00% or less is preferable.

(Ca: 0% or more and 0.010% or less)

(Mg: 0% or more and 0.010% or less)

(REM: 0% or more and 0.010% or less)

(Zr: 0% or more and 0.010% or less)

Ca (calcium), Mg (magnesium), REM (rare earth elements), and Zr (zirconium) are all elements which have the action of contributing to control of inclusions, in particular fine dispersion of inclusions, and of raising the toughness. Therefore, these elements may also be contained. However, in each element, if excessively contained, sometimes the surface conditions remarkably deteriorate. Therefore, the contents of these elements are respectively 0.010% or less. The contents of these elements are respectively preferably 0.008% or less or 0.005% or less, more preferably 0.003% or less. To obtain the effect due to this action more reliably, for each element, 0.0003% or more is sufficient. REM are the overall name for rare earth elements, i.e., Sc, Y, La, Ce, Pr, Nd, Pm, Sm, Eu, Gd, Tb, Dy, Ho, Er, Tm, Yb, and Lu. The content of REM means the total content of these elements.

In the cold rolled steel sheet according to the present embodiment, as the chemical composition, by mass %, at least one type of element among Ca: 0.0003% or more and 0.010% or less, Mg: 0.0003% or more and 0.010% or less, REM: 0.0003% or more and 0.010% or less, and Zr: 0.0003% or more and 0.010% or less is preferably contained.

In the cold rolled steel sheet according to the present embodiment, the balance other than the above constituents is comprised of Fe and impurities. The impurities are constituents, etc., entering due to various factors in the producing process such as the ore, scrap and other raw materials when industrially producing a cold rolled steel sheet.

The above chemical composition of the steel may be measured by general analytical methods of steel. For example, the chemical composition of the steel may be measured using inductively coupled plasma-atomic emission spectrometry (ICP-AES). C and S may be measured using the combustion-infrared absorption method, N using the inert gas fusion-thermal conductivity method, and O using the inert gas fusion-nondispersive infrared absorption method.

The metallic structure of the cold rolled steel sheet according to the present embodiment will be explained.

[Metallic Structure]

The cold rolled steel sheet according to the present embodiment has a metallic structure consisting of ferrite phases, hard second phases consisting of martensite phases and retained austenite phases, and remaining phases consisting of cementite phases and bainite phases, wherein an area ratio of the ferrite phases is 35% or more and 65% or less, an area ratio of the hard second phases is 35% or more and 65% or less, an area ratio of the remaining phases is 0% or more and 5% or less, 60% or more of the ferrite phases are recrystallized ferrite phases, an average crystal grain sizes defined by the 15° grain boundaries is 5.0 μm or less, a maximum connecting rate of hard second phases is 10% or more, and a two-dimensional isoperimetric constant of the hard second phases is 0.20 or less.

(Area Ratio of Ferrite Phases: 35% or More and 65% or Less)

The cold rolled steel sheet according to the present embodiment has an area ratio of 35% or more and 65% or less of ferrite phases. By having such structures, the soft phases contributing to improvement of the ductility can be sufficiently secured and an excellent uniform elongation and 60% or less yield ratio (YR) can be achieved. If the area ratio of the ferrite phases is less than 35%, the hard second phases become the main structures and excellent uniform elongation and YR of 60% or less cannot be achieved. The area ratio of the ferrite phases may for example be 38% or more, 40% or more, or 45% or more. On the other hand, if the area ratio of ferrite phases is more than 65%, the area ratio of the hard second phases becomes insufficient, so a 1180 MPa or more tensile strength cannot be achieved. The area ratio of the ferrite phases may be, for example, 60% or less, 58% or less, or 55% or less.

(Area Ratio of Hard Secondary Phases: 35% or More and 65% or Less)

The cold rolled steel sheet according to the present embodiment has an area ratio of 35% or more and 65% or less of hard second phases. The hard second phases are comprised of fresh martensite phases, tempered martensite phases, and retained austenite phases. When simply describing "martensite phases", it includes both "fresh martensite" and "tempered martensite". By having such structures, it is possible to sufficiently secure the hard phases contributing to improvement of the strength and achieve a 1180 MPa or more tensile strength (TS). If the area ratio of hard second phases is less than 35%, the martensite phases and retained austenite phases supporting the strength become insufficient and 1180 MPa or more tensile strength cannot be achieved. The area ratio of the hard second phases may for example be 38% or more, 40% or more, or 45% or more. On the other hand, if the area ratio of hard second phases is more than 65%, the area ratio of the soft phases of the ferrite phases is insufficient, so excellent uniform elongation and a YR of 60% or less cannot be achieved. The area ratio of the hard second phases is for example 63% or less, 60% or less, or 55% or less.

(Area Ratio of Remaining Phases: 0% or More and 5% or Less)

The cold rolled steel sheet according to the present embodiment has an area ratio of 0% or more and 5% or less of remaining phases. The remaining phases are comprised of cementite phases and bainite phases. If the cementite or bainite unavoidably included in the remaining part is more than 5%, the balance of the strength and uniform elongation falls, so it is not possible to realize excellent uniform elongation and a low yield ratio while maintaining the strength. For this reason, the area ratio of the remaining phases is 0% or more and 5% or less. Preferably, the area ratio of the remaining phases is 4% or less, 3% or less, 2% or less, or 1% or less.

(Recrystallized Ferrite Phases: 60% or More of Ferrite Phases)

In the present invention, the ferrite phases are classified into recrystallized ferrite phases not including dislocations in the grains due to recrystallization and nonrecrystallized ferrite phases including high densities of dislocations introduced in the grains by working in the cold rolling step. In dual-phase structure steel including ferrite phases and hard second phases, the yield point is strongly affected by the strength of the soft ferrite phases, so it is preferable to realize a low yield ratio and then control most of the ferrite phases to softer recrystallized ferrite phases. Therefore, in the present invention, 60% or more of the ferrite phases is recrystallized ferrite phases, preferably 70% or more, more preferably 80% or more, is recrystallized ferrite phases. If the recrystallized ferrite phases in the ferrite phases is less than 60%, the yield point of the ferrite phases rises and a yield ratio of 60% or less can no longer be achieved. Further, excellent uniform elongation is liable to be unable to be realized. The upper limit of the ratio of the recrystallized ferrite phases among the ferrite phases is not particularly prescribed and may be 100%, 95%, or 90%.

(Method of Measurement of Area Ratios of Phases)

The area ratios of the phases of the metallic structure are evaluated as follows by the SEM-EBSD method (electron backscatter diffraction method) and examination of the SEM secondary electron image.

First, a sample having a cross-section of thickness parallel to the rolling direction of the steel sheet as the observed surface was taken, the observed surface was machine polished to a mirror finish, then the surface was electrolytically polished. Next, in one or more observed fields in a range of ⅛ thickness to ⅜ thickness centered about ¼ thickness from the surface of the base metal steel sheet at the observed surface, a total area of $2.0\times10^{-9}$ $m^2$ or more is analyzed for crystal structure and orientation by the SEM-EBSD method. For analysis of the data obtained by the EBSD method, "OIM Analysis 6.0" made by TSL is used. Further, the distance between evaluation points (steps) is 0.03 to 0.20 μm. Regions judged as FCC iron from the results of observation are deemed retained austenite. Further, boundaries with differences in crystal orientations of 15 degrees or more are deemed grain boundaries to obtain a crystal grain boundary map.

Next, the same sample as that examined by EBSD is corroded by Nital and examined by a secondary electron image for the same fields as the examination by EBSD. To examine the same fields as the time of measurement by EBSD, Vickers indentations and other marks may be provided in advance. The obtained secondary electron image is used to measure the area ratios of the ferrite, retained austenite, bainite, tempered martensite, fresh martensite, and cementite. The regions having lower structures in the grains and having cementite precipitating in several variants are judged to be tempered martensite. The regions with small luminance and with no lower structures observed are judged to be ferrite. The regions with large luminance and with no lower structures revealed by etching are judged to be fresh martensite and retained austenite. The regions not corresponding to any of the above regions are judged to be bainite. The area ratios are calculated by the point counting method to obtain the area ratios of the phases.

(Method of Measurement of Ratio of Recrystallized Ferrite Phases)

In all of the ferrite regions found above, using a field emission type scanning electron microscope (FE-SEM) and OIM crystal orientation analysis apparatus, the regions of recrystallized ferrite were observed at the same regions as the regions observed by the SEM above. Measurement surface 100 μm square regions were examined at 0.2 μm intervals to obtain groups of crystal orientation data. The obtained groups of crystal orientation data were analyzed by analysis software (TSL OIM Analysis). Regions with kernel average misorientations (KAM values) between first neighboring side measurement points in the ferrite crystal grains of 1.0° or less are defined as recrystallized regions. The area ratio of those regions with respect to all regions is calculated and the ratio of recrystallized ferrite phases in the ferrite phases are determined.

(Average Crystal Grain Size Defined by 15° Grain Boundaries: 5.0 μm or Less)

By refining the crystal grain sizes, the strength of the metallic structure can be improved. In dual phase structure steel containing ferrite phases and hard second phases, the effect in making the deformation uniform is large. By the deformation being made uniform, uniform elongation can be secured while strength can be secured. If the average crystal grain size defined by the 15° grain boundaries is more than 5.0 μm, deformation easily unevenly occurs and realizing both strength and uniform elongation becomes difficult. For this reason, the average crystal grain size defined by the 15° grain boundaries is 5.0 μm or less. Preferably, it is 3.0 μm or less, more preferably 2.5 μm or less. In the present invention, the grain boundaries of the ferrite phases and hard second phases can both be judged for individual grains by the 15° grain boundaries, so the areas of the grains discriminated by the 15° grain boundaries are calculated as the circle equivalent diameters and used as the grain sizes.

(Method of Measurement of Average Crystal Grain Size)

The average crystal grain size was measured by the SEM/EBSD method. A sample was taken at ¼ thickness from the surface of the steel sheet with a cross-section of thickness parallel to the rolling direction of the steel sheet as the observed surface. The surface of the steel sheet was polished to a mirror finish and polished by colloidal silica. A field emission type scanning electron microscope (FE-SEM) and OIM crystal orientation analysis apparatus were used to obtain groups of crystal orientation data for measurement surface 200 μm square regions at 0.2 μm intervals. The obtained groups of crystal orientation data were analyzed by analysis software (TSL OIM Analysis), the interfaces having differences of orientations of 15° or more were defined as crystal grain boundaries, the crystal grain sizes were calculated as circle equivalent diameters from the areas surrounded by the crystal grain boundaries, and the average crystal grain size was calculated as the median diameter (D50) from the histogram of these crystal grain sizes.

In the present invention, to simultaneously achieve a 1180 MPa or more tensile strength, excellent uniform elongation, and 60% or less yield ratio, in addition to the above-mentioned chemical composition, area ratios of the phases, ratio of the recrystallized ferrite phases in the ferrite phases, and average crystal grain size, control of the morphology of the steel sheet is the most important point. That is, as explained above, by controlling the dual phase structure containing soft recrystallized ferrite phases and hard second phases (martensite phases or retained austenite phases) in constant amounts or more to become a morphology where improvement of the ductility by the ferrite phase and securing of the strength by the hard second phases are realized in a complementary manner, it is possible to realize the above-mentioned target properties.

The inventors discovered that for realizing both improvement of the ductility by the ferrite phases and securing of the strength by the hard second phases in a complementary manner to the maximum extents, it is effective that these two phases have mutually intricately intertwined structures.

The microstructure having intricately intertwined structures is characterized by the hard second phases being connected and by the interfacial area being greater than with true circular shaped particles having the same areas. When having intricately intertwined structures, while the reasons why the above-mentioned effects are obtained are not necessarily clear, it is surmised that the localization of deformation is suppressed to distribute the deformation between soft and hard phases and a uniform yield phenomenon occurs in the microstructure as a whole. In the present invention, "the maximum connecting rate of the hard second phases" is used as an indicator showing the hard second phases are connected together and the "two-dimensional isoperimetric constant of the hard second phases" is used as an indicator of a large interfacial area of the soft phases and hard phases.

(Maximum Connecting Rate of Hard Secondary Phases of 10% or More)

To obtain the above-mentioned effect, the maximum connecting rate of the hard second phases has to be 10% or more. If the maximum connecting rate of the hard second phases is 10% or more, the soft phases and hard phases have sufficiently intricately intertwined structures, so a yield phenomenon evenly occurs in the metallic structure as a whole and a TS of 1180 MPa or more and a YR of 60% or less can be simultaneously achieved. The maximum connecting rate of the hard second phases is preferably 15% or more, more preferably 20 or more, still more preferably 25% or more, most preferably 30% or more. The upper limit is not particularly defined, but may be 100% or less, 90% or less, 80% or less, or 70% or less.

(Two-Dimensional Isoperimetric Constant of Hard Secondary Phases: 0.20 or Less)

Further, to obtain the above-mentioned effect, the two-dimensional isoperimetric constant of the hard second phases has to be 0.20 or less. If the two-dimensional isoperimetric constant of the hard second phases is 0.20 or less, the metallic structure forms a sufficiently uniform network, so it is possible to secure strength by the hard second phases, draw upon the ductility of the ferrite phases at the time of deformation, and simultaneously realize a TS of 1180 MPa or more and a YR of 60% or less. The two-dimensional isoperimetric constant of the hard second phases is preferably 0.15 or less, more preferably 0.12 or less, still more preferably 0.10 or less. The lower limit is not particularly defined, but may be 0.01 or more, 0.02 or more, or 0.03 or more.

The maximum connecting rate of the hard second phases and the two-dimensional isoperimetric constant will be explained in more detail below. FIG. 1 schematically shows a maximum connected region 1 in a steel sheet microstructure. The maximum connected region 1 is a microstructure where hard second phases are continuously connected with each other in a mesh form. In FIG. 1, the finely hatched part is the maximum connected region 1, the white parts are the ferrite structure regions 2, and the roughly hatched part is a hard second phase region 3 not the maximum connected region 1 (nonmaximum connected region 3). To facilitate their differentiation, the maximum connected region 1 and nonmaximum connected region 3 are shown with opposite slants of hatching. In the maximum connected region 1, the plurality of ferrite regions (white parts) are present in mutually separate states. Further, the nonmaximum connected region 3 is separated from the maximum connected region 1. The nonmaximum connected region 3 is surrounded by ferrite regions (white parts).

The maximum connecting rate of the hard second phases is determined by the following method. A secondary electron image measured by FE-SEM by 1000× (measured surface 200 μm square region) at a region down to the position of t/2 depth from the position of the depth ⅜t from the surface (t: thickness of steel sheet) is binarized by the above method and one pixel showing a hard second phase region is selected in the binarized image. Further, if a pixel adjoining the thus selected pixel (pixel showing hard second phase region) in any direction of the four directions of up, down, left, and right shows a hard second phase region, these two pixels are judged to be the same connected region. In the same way, it is successively judged if the pixels adjoining it in the up, down, left, and right directions are connected regions to determine the range of a single connected region. If the adjoining pixel is not a pixel showing a hard second phase region (i.e., if the adjoining pixel is a pixel showing a ferrite region), the part becomes a part of the edge of the connected region. The region having the greatest number of pixels in the connected region of hard second phases is identified as the "maximum connected region".

The area ratio of the maximum connected region of hard second phases with respect to all of the hard second phase regions, i.e., the maximum connecting rate of the hard second phases Rs, is obtained by finding the area Sm of the maximum connected region and calculating it from the ratio Rs=Sm/Ss of the sum hard second phase regions with the area Ss.

The maximum connecting rate Rs (%) is calculated by the following formulas:

$$Rs=\{\text{area } Sm \text{ of maximum connected region of hard second phases/area } Ss \text{ of sum hard second phase regions}\}\times 100$$

$$\text{Area } Ss \text{ of sum hard second phase regions}=\text{area } Sm \text{ of maximum connected region}+\text{total area } Sm' \text{ of nonmaximum connected region}$$

The two-dimensional isoperimetric constant K is calculated by the following formulas. The perimeter Lm of the maximum connected region can be measured in the structural image measured by the above FE-SEM. However, when calculating the perimeter, if any of the four sides of the image data frame corresponds to part of the perimeter of the maximum connected region, the length of the corresponding frame is also treated as part of the perimeter of the maximum connected region.

$$\pi\cdot(Lm/2\pi)^2\cdot K=Sm$$

$$K=4\pi Sm/Lm^2$$

Lm: perimeter of maximum connected region of hard second phases

Figure 2:
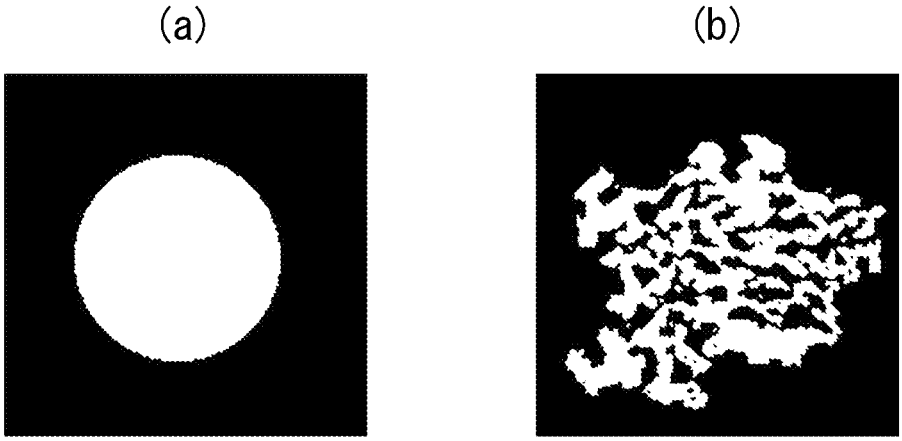
FIG. 2 is a schematic view of a binarized image explaining a two-dimensional isoperimetric constant.

FIG. 2 is a schematic view of a binarized image for explaining a two-dimensional isoperimetric constant. FIG. 2(*a*) is a schematic view showing the case where the maximum connected region of hard second phases is substantially circular. On the other hand, FIG. 2(*b*) is a schematic view showing the case where the maximum connected region has the same area (Sm) as FIG. 2(*a*) and has an interfacial shape of hard phases and soft phases intricately intertwined. For example, for the structure of FIG. 2(*a*), if measuring the perimeter Lm of the maximum connected region and calculating the two-dimensional isoperimetric constant K based on the above formula, K=0.92. On the other hand, FIG. 2(*b*) is the same in area Sm of the maximum connected region as FIG. 2(*a*), but the perimeter Lm of the maximum connected region is long, and therefore if similarly calculating the two-dimensional isoperimetric constant K, K=0.03. From the explanation relating to FIG. 1 and a comparison of FIGS. 2(*a*) and (*b*), etc., it will be understood that, as prescribed in the present embodiment, by making the maximum connecting rate of the hard second phases 10% or more while making the two-dimensional isoperimetric constant of the hard second phases 0.20 or less, it is possible to form a relatively large maximum connected region having an interfacial shape of hard phases and soft phases intricately intertwined in the metallic structure. For this reason, according to the present embodiment, it becomes possible to realize the improvement in ductility by the soft phases and the securing of strength by the hard phases in a complementary manner.

The cold rolled steel sheet according to the present invention may also have a hot dip galvanized layer or hot dip galvannealed layer on the surface for the purpose of improvement of the corrosion resistance.

Next, the mechanical properties of the cold rolled steel sheet according to the present embodiment will be explained.

[Mechanical Properties]

(Tensile Strength TS: 1180 MPa or More)

The cold rolled steel sheet according to the present embodiment preferably has sufficient strength for contributing to lighter weight of automobiles. For this reason, the tensile strength (TS) is 1180 MPa or more. The tensile strength is preferably 1270 MPa or more, more preferably 1370 MPa or more. The tensile strength is preferably high, but with the configuration of the present embodiment, more than 1780 MPa is difficult, so the substantive upper limit becomes 1780 MPa. The tensile test may be performed based on JIS Z2241 (2011). The sample for the tensile test use may be obtained from ¼ of the width direction of the cold rolled steel sheet so that the direction vertical to the rolling direction (C direction) becomes the longitudinal direction (JIS No. 5 test piece).

(Excellent Uniform Elongation uEL)

The value of excellent uniform elongation differs depending on the class of strength of the steel sheet. In the cold rolled steel sheet according to the present invention, the tensile strength is 1180 MPa or more, but the uniform elongation sought differs according to the class of strength. Explaining this specifically in cold rolled steel sheet with a tensile strength of 1180 to 1370 MPa, tensile strength and excellent uniform elongation become necessary. On the other hand, if the tensile strength is more than 1370 MPa, a higher tensile strength is demanded even if the uniform elongation characteristic is sacrificed somewhat. Therefore, in the present invention, the steel sheet having "excellent uniform elongation" is steel sheet satisfying the following conditions with respect to the tensile strength. The uniform elongation is obtained, in the same way as the case of tensile strength, by performing a tensile test using a JIS No. 5 test piece taken from a position of ¼ of the width direction of the cold rolled steel sheet so that the direction vertical to the rolling direction (C direction) becomes the longitudinal direction based on the provisions of JIS Z 2241 (2011).

In the case where tensile strength TS: 1180 to 1370 MPa
uniform elongation uEL≥10.0%

In the case where tensile strength TS: more than 1370 MPa
uniform elongation uEL≥7.0%

(Yield Ratio YR≤60%)

The cold rolled steel sheet according to the present embodiment has sufficient strength for contributing to lighter weight of automobiles while must be provided with excellent shape fixability and workability. The yield ratio YR is 60% or less. Preferably, the YR is 58% or less, more preferably the YR is 55% or less. The yield ratio YR is the ratio of the yield point YS to the tensile strength TS and is expressed by YR (%)=(YS/TS)×100. The yield point as well, in the same way as the case of the tensile strength, is found by using a JIS No. 5 test piece taken from a position of ¼ in the width direction of cold rolled steel sheet so that the direction vertical to the rolling direction (C direction) becomes the longitudinal direction and performing a tensile test based on the provisions of JIS Z 2241 (2011).

Next, the method for producing the cold rolled steel sheet according to the present embodiment will be explained.

<Method for Producing Cold Rolled Steel Sheet>

In the present invention, by the four steps of (a) a hot rolling step storing rolling strain while controlling the microstructure to uniform low temperature transformed phases (upper bainite phases, martensite phases, or mixed phases comprised of the same), (b) a tempering step making the iron carbides uniformly and finely precipitate, (c) a cold rolling step imparting a driving force for recrystallization of ferrite, and (d) an annealing step for making ferrite sufficiently recrystallize during heating, pinning the recrystallized ferrite grain boundaries by iron carbides, and promoting growth of austenite along the grain boundaries to thereby make the soft phases and hard phases uniformly and finely disperse and control the interfacial shape of the two phases to an intricately intertwined morphology, it is possible to make the ferrite phases of the soft phases and the hard second phases comprised of martensite phases and retained austenite phases present in desired area ratios, disperse the phases uniformly and finely, and control the interfacial shapes to an intricately intertwined morphology. Explained more specifically, by arranging iron carbides on the recrystallized ferrite grain boundaries and pinning the recrystallized ferrite grain boundaries, it is believed that not only are the crystal grains refined, but also the directions of growth of the austenite follow along the grain boundaries, and therefore intricately shaped austenite can be formed between the spaces of ferrite along the grain boundaries. Therefore, it is possible to control the metallic structure of the finally obtained steel sheet to a morphology where soft phases and hard phases are intricately intertwined and as a result, for example, it becomes possible to obtain the characteristic metallic structure according to the present invention where the two-dimensional isoperimetric constant of the hard second phases is 0.20 or less. Below, the steps in the method for producing the cold rolled steel sheet according to the present invention will be explained in detail.

The producing step preceding the hot rolling step is not particularly limited. That is, it is sufficient to perform smelting by a blast furnace or electric furnace, etc., then perform various secondary refining, then perform casting by the usual continuous casting, casting by the ingot method, thin slab casting, or another method. In the case of continuous casting, the cast slab is cooled once to a low temperature, then again heated and then hot rolled. It is also possible to not cool the cast slab down to a low temperature, but hot roll it as is after casting. For the raw material, scrap may also be used. The chemical composition of the slab is adjusted to a chemical composition such as explained above.

The cast slab is heat treated. In this heating step, for example, the slab may be heated to 1200° C. or more and 1300° C. or less temperature, then held there for 30 minutes or more. If the heating temperature is less than 1200° C., the Ti- and Nb-based precipitates are not sufficiently melted, so sufficient precipitation strengthening is liable to be unable to be obtained at the time of the later step of hot rolling. Further, sometimes these remain in the state as coarse carbides whereby the shapeability is degraded. Therefore, the heating temperature of the slab is preferably 1200° C. or more. 1220° C. or more is more preferable. On the other hand, if the heating temperature is more than 1300° C., the amount of formation of scale increases and the yield is liable to fall, so the heating temperature is preferably 1300° C. or less, more preferably 1280° C. or less. To make the Ti- and Nb-based precipitates sufficiently melt, the sheet is preferably held at this temperature range for 30 minutes or more. For example, it may also be held there for 45 minutes or more, 60 minutes or more, 90 minutes or more, or 120 minutes or more. Further, to suppress excessive scale loss, the holding time is preferably 10 hours or less, more preferably 5 hours or less.

[Hot Rolling Step]

(Rough Rolling)

In the hot rolling step in the present invention, the sheet is rough rolled, then rolled by multi-stage finish rolling. First, the heated slab is rough rolled. In this rough rolling, the slab need only be rendered the desired dimensions and shape. The conditions are not particularly limited. The thickness of the rough rolled steel sheet has an effect on amount of temperature drop from the front end to tail end of the rolled sheet occurring from the time of start of rolling to the time of end of rolling in the finish rolling step, and therefore is preferably determined considering this.

(Finish Rolling)

In the finish rolling, by controlling the rolling reduction of the final stage in the multistage finish rolling to 15% or more and 50% or less and controlling the rolling end temperature of the final stage to Ar3° C. or more and 950° C. or less, it becomes important to raise the stored strain of the prior austenite grains at the time of hot rolling and increase the density of the nucleation sites of the iron carbides.

(Rolling Reduction of Final Stage of Finish Rolling: 15% or More and 50% or Less)

If the rolling reduction of the final stage of the finish rolling is less than 15%, the amount of stored strain of the prior austenite grains is not sufficient, the precipitation sites of the iron carbides decrease, refinement of the crystal grains cannot be achieved in the annealing step after the cold rolling step, and the desired tensile strength and uniform elongation cannot be simultaneously obtained. Therefore, the rolling reduction of the final stage of the finish rolling is 15% or more. The rolling reduction of the final stage of the finish rolling is preferably 16% or more, more preferably 18% or more, still more preferably 20% or more. On the other hand, if the rolling reduction of the final stage of the finish rolling is more than 50%, the steel sheet remarkably deteriorates in shape and rolling becomes difficult, so the rolling reduction of the final stage of the finish rolling is 50% or less. The rolling reduction of the final stage of the finish rolling is preferably 45% or less, more preferably 40% or less.

(End Temperature of Finish Rolling: Ar3° C. or More and 950° C. or Less)

If the end temperature of the finish rolling becomes less than Ar3° C., ferrite and pearlite are formed, uniform low temperature transformed phase structures cannot be realized, the recrystallized ferrite grain boundaries cannot be pinned by the iron carbides, and the shape of the boundaries of the soft phases and hard phases is liable to be unable to be controlled to an intricately intertwined morphology. For this reason, the end temperature of the finish rolling is Ar3° C. or more. On the other hand, if the end temperature of the finish rolling is more than 950° C., the stored strain of the prior austenite grains is reduced by the recovered recrystallization whereby the precipitation sites of iron carbides are reduced and the interfacial shapes of the soft phases and hard phases are liable to be unable to be controlled to an intricately intertwined morphology. For this reason, the finish rolling end temperature is 950° C. or less. The finish rolling end temperature is preferably (Ar3+10)° C. or more, more preferably (Ar3+20)° C. The finish rolling end temperature is preferably 940° C. or less, more preferably 930° C. or less.

(Average Cooling Rate: 50° C./s or More)

The hot rolled steel sheet after the finish rolling is cooled down to the coiling temperature. If the average cooling rate after the finish rolling is less than 50° C./s, ferrite and pearlite precipitate during cooling, uniform low temperature transformed phase structures cannot be obtained, and a fine intricately intertwined morphology cannot be obtained, so the average cooling rate is 50° C./s or more. The average cooling rate is preferably 70° C./s or more, more preferably 100° C./s or more. The upper limit of the average cooling rate is not particularly prescribed, but from the viewpoint of stable production, it is preferably 200° C./s or less.

(Coiling Temperature: Less Than 400° C.)

If coiling at 400° C. or more temperature, ferrite and pearlite or bainitic ferrite precipitates, whereby it is not possible to control the microstructure of the hot rolled steel sheet to uniform low temperature transformed phases and a fine and intricately intertwined morphology cannot be obtained. For this reason, the coiling is performed at less than 400° C. temperature. The coiling temperature is preferably 380° C. or less, more preferably 350° C. or less, still more preferably 100° C. or less.

[Tempering Step]

In the present invention, pinning of recrystallized ferrite grain boundaries by iron carbides and formation of austenite from the pinning particles of iron carbides are utilized to thereby realize a fine and intricately intertwined morphology. Therefore, control of the iron carbides in the tempering step of hot rolled steel sheet is an extremely important control process even in the present application.

By tempering the hot rolled steel sheet after coiling, an amount of iron carbides required for pinning the recrystallized ferrite grain boundaries is made to precipitate. Here, the pinning force of recrystallized ferrite grain boundaries by iron oxides is proportional to the amount of precipitation of the pinning particles of iron oxide and inversely proportional to the particle size of iron carbides, so to effectively cause the pinning force to be generated, it is preferable to cause fine iron carbides to precipitate in large amounts. On the other hand, the larger the particle size of the iron carbides, the higher the frequency of nucleation of austenite starting from the iron carbides on the grain boundaries, so from the viewpoint of obtaining both the pinning force and austenite nucleation, it is necessary to control the particle size of the iron carbides to a suitable range.

In the present invention, the inventors discovered that by performing tempering in suitable ranges of temperature and heat treatment time, it becomes possible to suitably control the amount of precipitation and particle size of the iron carbides, secure the pinning force of the recrystallized ferrite grain boundaries, and utilize the iron carbides on the grain boundaries as austenite nucleation sites. Specifically, the tempered heat treatment is performed at a tempering temperature of 450° C. or more and less than 600° C. in temperature range so that the tempering parameter ξ becomes 14000 to 18000. By performing such heat treatment, it is possible to sufficiently obtain the pinning effect by iron carbides to obtain a fine and intricately intertwined morphology. As a result, for example, it becomes possible to obtain a metallic structure with a two-dimensional isoperimetric constant of the hard second phases of 0.20 or less.

(Tempering Temperature: 450° C. or More and Less Than 600° C.)

The tempering temperature is 450° C. or more and less than 600° C. If the tempering temperature is less than 450° C., the particle size of the iron carbides becomes excessively fine, the effect as a nucleation site of austenite cannot be sufficiently obtained, and a fine and intricately intertwined morphology cannot be obtained. For this reason, the tempering temperature is 450° C. or more. The tempering temperature is preferably 500° C. or more. On the other hand, if 600° C. or more, Ostwald ripening of the iron carbides causes the pinning force of the iron carbides to remarkably fall and a fine and intricately intertwined morphology cannot be obtained. For this reason, the tempering heat treatment temperature is less than 600° C. The tempering temperature is preferably 550° C. or less.

(Tempering Parameter ξ: 14000 or More and 18000 or Less)

If the tempering parameter ξ is less than 14000, the amount of precipitation of iron carbides becomes insufficient, the pinning force of recrystallized ferrite grain boundaries by iron carbides becomes insufficient, and a 5.0 μm or less average particle size cannot be realized. On the other hand, if the tempering parameter ξ is more than 18000, excessive growth of the iron carbides causes the pinning force of the recrystallized ferrite grain boundaries to become insufficient and 5.0 μm or less average grain size to be unable to be realized. For this reason, the tempering parameter ξ is 14000 or more and 18000 or less. Preferably, the tempering parameter is 14500 or more, 15000 or more, or 15500 or more. Further, preferably, the tempering parameter is 17500 or less, 17000 or less, or 16500 or less. The tempering parameter ξ can be found by following Formula 1.

$$\xi=(T+273)\cdot[\log_{10}(t/3600)+20] \quad \text{Formula 1:}$$

T [° C.]: tempering temperature, t [s]: tempering time

[Cold Rolling Step]

(Rolling Reduction: 30% or More)

The steel sheet tempered in the above way is pickled, then cold rolled. If the rolling reduction of the cold rolling step is less than 30%, the driving force of recrystallization of the ferrite is not sufficient and nonrecrystallized ferrite remains, so the rolling reduction of the cold rolling step is 30% or more. The rolling reduction is preferably 35% or more, more preferably 40% or more, more preferably 45% or more. On the other hand, no upper limit of the cold rolling reduction is particularly provided, but if a more than 70% rolling reduction, sometimes the rolling load becomes too high and rolling does not become possible or there is a danger of the steel sheet fracturing during rolling, so the rolling reduction is preferably 70% or less.

In the present invention, due to the iron oxides made to precipitate due to tempering the steel sheet after the hot rolling step, the recrystallized ferrite grain boundaries are pinned and softening of the base phase ferrite and refinement of the crystal grains are achieved. Due to the austenite transformation using the iron carbides on these grain boundaries as nucleation sites, the morphology becomes intricately intertwined. The reason why the morphology becomes an intricately intertwined shape by using the iron carbides on the grain boundaries as austenite nucleation sites is not necessarily clear, but it may be that the main reason is that anisotropy occurs in the direction of growth of the austenite due to the difference in the grain boundary diffusion coefficient due to the tilt angle of the ferrite grain boundaries contacting the iron carbides. That is, by utilizing the austenite transformation from the iron carbides on the grain boundaries, it is possible to realize not a microstructure like in the past where the martensite or other hard second phases completely cover the surroundings of the ferrite grains, but a morphology where the ferrite and hard second phases are intricately intertwined.

[Annealing Step]

(Average Heating Rate From 500° C. to Ac1° C.: 5.0° C./s or Less)

The steel sheet cold rolled in the above way is annealed by heating it to the maximum heating temperature, holding it there, then cooling it. In the heating process from 500° C. to Ac1° C., the ferrite phases are recrystallized after cold rolling and the recrystallized ferrite grain boundaries are pinned by the iron carbides. If the average heating rate from 500° C. to Ac1° C. is more than 5.0° C./s, the recrystallization of ferrite does not sufficiently occur and further sufficient iron carbides cannot be placed on the recrystallized ferrite grain boundaries, and austenite transformation is started, so it is not possible to obtain a morphology where soft phases and hard second phases are sufficiently intricately intertwined. For this reason, the average heating rate from 500° C. to Ac1° C. is 5.0° C./s or less. The average heating rate is preferably 4.0° C./s or less, more preferably 3.0° C./s or less.

(Maximum Heating Temperature: (Ac1+10)° C. or More (Ac3−10)° C. or Less)

If the maximum heating temperature of the annealing step is less than the (Ac1+10)° C., it is not possible to secure 35% or more hard second phases, so the maximum heating temperature is the (Ac1+10)° C. or more. On the other hand, if more than (Ac3−10)° C., austenite transformation excessively proceeds and the structural fraction of hard second phases becomes more than 65%, so the maximum heating temperature is (Ac3−10)° C. or less. The maximum heating temperature is preferably (Ac1+20)° C. or more, more preferably (Ac1+30)° C. or more. Further, the maximum heating temperature is preferably (Ac3−20)° C. or less, more preferably (Ac3−30)° C. or less.

(Holding Time at Maximum Heating Temperature: 60 Seconds or More)

If the holding time at the maximum heating temperature is less than 60 seconds, the melting time of the iron carbides becomes insufficient, iron carbides remain unmelted as impurities, i.e., the area ratio of the remaining phases becomes higher, so the holding time is 60 seconds or more. On the other hand, if the holding time is more than 1200 seconds, production is interfered with and an increase in costs is led to, so the heating holding time is preferably 1200 seconds or less. Preferably, the holding time at the maximum heating temperature is 120 seconds or more, 180 seconds or more, 240 seconds or more, or 300 seconds or more.

(Average Cooling Rate From (Ac1−50)° C. to Ms° C. or Less Cooling End Temperature: 20° C./s or More)

If the average cooling rate from (Ac1−50)° C. to an Ms° C. or less cooling end temperature is less than 20° C./s, this becomes a factor due to which pearlite and bainitic ferrite are formed during cooling, the area ratio of the remaining phases increases, and the desired yield ratio can no longer be obtained, so the average cooling rate is 20° C./s or more. The average cooling rate is preferably 30° C./s or more, 40° C./s or more, or 50° C./s or more. Further, the upper limit of the average cooling rate is not particularly limited, but for example may be 100° C./s or less.

(Cooling End Temperature: Ms° C. or Less)

If the cooling end temperature is more than Ms° C., after the cooling, pearlite and bainitic ferrite are formed, the area ratio of the remaining phases increases, and the balance of tensile strength and the uniform elongation falls. For this reason, the cooling end temperature is the Ms point or less. Preferably, the cooling end temperature is (Ms−10)° C. or less, (Ms−20)° C. or less, or (Ms−30)° C. or less. The lower limit of the cooling end temperature is not particularly limited, but may also be room temperature or so (for example, 20° C.).

The above-mentioned transformation points: Ac1 (° C.), Ac3 (° C.), Ar3 (° C.), and Ms (° C.) are calculated by the following formulas:

$$Ac1\ [°\ C.]=751-16\times[\%\ C]+35\times[\%\ Si]-28\times[\%\ Mn]$$

$$Ac3\ [°\ C.]=881-353\times[\%\ C]+65\times[\%\ Si]-24\times[\%\ Mn]$$

$$Ar3\ [°\ C.]=910-203\times[\%\ C]+44.7\times[\%\ Si]-24\times[\%\ Mn]-50\times[\%\ Ni]$$

$$Ms\ [°\ C.]=521-353\times[\%\ C]-22\times[\%\ Si]-24\times[\%\ Mn]$$

Here, % C, % Si, % Mn, and % Ni are the contents of C, Si, Mn, and Ni [mass %].

The cold rolled steel sheet according to the present invention can be obtained by the above four steps, i.e., the hot rolling step, tempering step, cold rolling step, and annealing step. In addition to these steps, the following additional steps, i.e., a reheating step, hot dip galvanization step, hot dip galvanization step, and alloying step, may be performed.

[Reheating Step]

(Reheating Temperature of 200° C. or More and 450° C. or Less)

In the annealing step, after cooling to the Ms° C. or less temperature, for the purpose of improving the uniform elongation, the steel sheet may be reheated to 200° C. or more and 450° C. or less temperature. If the reheating temperature is less than 200° C., sometimes the effect of raising the uniform elongation cannot be effectively exhibited. If the reheating temperature is more than 450° C., cementite precipitates, i.e., the area ratio of the remaining phases increases and sometimes a yield ratio YR of 60% or less can no longer be achieved, so the reheating temperature is preferably made 200° C. or more and 450° C. or less. The reheating temperature is preferably 250° C. or more, more preferably 300° C. or more. Further, the reheating temperature is preferably 400° C. or less, more preferably 350° C. or less.

(Holding Time at Reheating Temperature: 60 Seconds or More and 600 Seconds or Less)

If the holding time at the reheating temperature is less than 60 seconds, the effect of raising the uniform elongation cannot be sufficiently obtained, so the holding time is preferably 60 seconds or more. On the other hand, if the holding temperature at the reheating temperature becomes more than 600 seconds, the yield point is improved and a yield ratio YR of 60% or less is liable to be unable to be obtained. For this reason, the holding time is preferably 600 seconds or less. More preferably, the holding time at the reheating temperature is 550 seconds or less, 500 seconds or less, 450 seconds or less, or 400 seconds or less.

[Hot Dip Galvanization Step]

In the hot dip galvanization step, the cold rolled annealed sheet after the annealing step is hot dip galvanized by heating it from the Ms point or less cooling temperature to a predetermined temperature suitable for hot dip galvanization, then dipping the cold rolled annealed sheet in a hot dip galvanization bath to form a hot dip galvanized layer on the surface. The hot dip galvanization conditions do not particularly have to be limited. The cold rolled annealed sheet is dipped in the hot dip galvanization bath and formed on its surface with a predetermined thickness of hot dip galvanized layer. Any of the usual hot dip galvanization conditions may be applied. For example, the hot dip galvanization may be performed at 430° C. or more. If the temperature of the steel sheet when entering the hot dip galvanization bath falls below 430° C., there is a possibility of the zinc deposited on the steel sheet aggregating, so if the austempering temperature falls below 430° C., the steel sheet is preferably heated to a predetermined temperature before entering the hot dip galvanization bath. Further, after the hot dip galvanization, wiping may also be performed to adjust the amount of coating deposition in accordance with need. The temperature of the hot dip galvanization may, for example, be 500° C. or less.

[Alloying Step]

The hot dip galvanized steel sheet formed with the hot dip galvanized layer may also be alloyed in accordance with need. In this case, if the alloying temperature is less than 400° C., the alloying rate becomes slow and the productivity is impaired. Not only that, unevenness occurs in the alloying, so the alloying temperature is 400° C. or more. On the other hand, if the alloying temperature is more than 600° C., the alloying excessively proceeds and sometimes the coating adhesion of the steel sheet deteriorates. Therefore, the alloying temperature is 600° C. or less.

EXAMPLES (Preparation of Samples of Cold Rolled Steel Sheet)

Slabs having the chemical compositions shown in Table 1 were processed by a hot rolling step, tempering step, cold rolling step, and annealing step under the conditions shown in Table 2 to obtain thickness 1.5 mm cold rolled steel sheets. Sample Nos. 19 to 21 and 34 were processed by a reheating step after the annealing step. Sample No. 22 was hot dip galvanized at 450° C. This was indicated as "GI" in Table 2. Sample No. 42 was hot dip galvanized at 450° C., then was alloyed at 460° C. In Table 2, this is shown as "GA". Further, in Table 2, "RT" means "room temperature".

The transformation points Ac1 (° C.), Ac3 (° C.), Ar3 (° C.), and Ms (° C.) of Table 1 and Table 2 were calculated from the following formulas:

$$Ac1\ [°\ C.]=751-16\times[\%\ C]+35\times[\%\ Si]-28\times[\%\ Mn]$$

$$Ac3\ [°\ C.]=881-353\times[\%\ C]+65\times[\%\ Si]-24\times[\%\ Mn]$$

$$Ar3\ [°\ C.]=910-203\times[\%\ C]+44.7\times[\%\ Si]-24\times[\%\ Mn]-50\times[\%\ Ni]$$

$$Ms\ [°\ C.]=521-353\times[\%\ C]-22\times[\%\ Si]-24\times[\%\ Mn]$$

The tempering parameter of Table 2 was calculated from following Formula 1.

$$\xi=(T+273)\cdot[\log_{10}(t/3600)+20] \quad \text{Formula 1:}$$

T [° C.]: the tempering temperature, t [s]: tempering time (Determination of Metallic Structures)

The area ratios of the phases of the metallic structures of Table 3 were evaluated by the SEM-EBSD method and observation of SEM secondary electron images. Specifically, first, in each, a sample was taken with the cross-section of thickness parallel to the rolling direction of the steel sheet as the observed surface. The observed surface was machine polished to a mirror finish, then was electrolytically polished. Next, at five observed fields in the range of ⅛ thickness to ⅜ thickness centered at ¼ thickness from the surface of the base metal steel sheet at the observed surface, a total area of $1.0\times10^{-8}$ $m^2$ was analyzed for crystal structure and orientation by the SEM-EBSD method. For analysis of the data obtained by the EBSD method, "OIM Analysis 6.0" made by TSL was used. Further, the distance between evaluation points (steps) was 0.10 μm. From the results of observation, the regions judged to be FCC iron were deemed retained austenite and further the boundaries with differences of crystal orientations of 15 degrees or more were deemed grain boundaries to obtain a crystal grain boundary map. Next, samples the same as those examined for EBSD were corroded by Nital and secondary electron images were observed at the same fields as the observation by EBSD. The obtained secondary electron image is used to measure the area ratios of ferrite, retained austenite, bainite, tempered martensite, fresh martensite, and cementite. The regions having lower structures in the grains and having cementite precipitating in several variants are judged to be tempered martensite, the regions with small luminance and with no lower structures observed are judged to be ferrite, and the regions with large luminance and with no lower structures revealed by etching are judged to be fresh martensite and retained austenite. The regions not corresponding to any of the above regions are judged to be bainite. The area ratios are calculated by the point counting method to obtain the area ratios of the phases.

(Measurement of Ratio of Recrystallized Ferrite Phases)

In all of the ferrite regions found above, the regions of recrystallized ferrite were observed at the same regions as the regions observed by the SEM above using an FE-SEM and OIM crystal orientation analysis apparatus. Measurement surface 100 μm square regions were examined at 0.2 μm intervals to obtain groups of crystal orientation data. The obtained groups of crystal orientation data were analyzed by analysis software (TSL OIM Analysis). Regions with KAM values between first neighboring side measurement points in the ferrite crystal grains of 1.0° or less are defined as recrystallized regions. The area ratios of those regions with respect to all of the regions is calculated and the ratio of recrystallized ferrite phases in the ferrite phases are determined. The ratio of the obtained recrystallized ferrite is shown in Table 3.

(Measurement of Average Crystal Grain Size)

The average crystal grain size was measured by the SEM/EBSD method. In each case, a sample was taken at ¼ thickness from the surface of the steel sheet with a cross-section of thickness parallel to the rolling direction of the steel sheet as the observed surface. The surface of the steel sheet was polished to a mirror finish and polished by colloidal silica. A field emission type scanning electron microscope (FE-SEM) and OIM crystal orientation analysis apparatus were used to obtain groups of crystal orientation data for measurement surface 200 μm square regions at 0.2 μm intervals. The obtained groups of crystal orientation data were analyzed by analysis software (TSL OIM Analysis), the interfaces having differences of orientations of 15° or more were defined as crystal grain boundaries, the crystal grain sizes were calculated as circle equivalent diameters from the areas surrounded by the crystal grain boundaries, and the average crystal grain size was calculated as the median diameter (D50) from the histogram of these crystal grain sizes.

(Measurement of Maximum Connecting Rate of Hard Secondary Phases)

(Measurement of Two-Dimensional Isoperimetric Constant of Hard Secondary Phases)

The maximum connecting rate of the hard second phases was determined by the following method. A structural image measured by FE-SEM by 1000× at a region down to the position of t/2 depth from the position of the depth ⅜t from the surface (t: thickness of steel sheet) was binarized and one pixel showing the hard second phase region was selected in the binarized image. Further, if a pixel adjoining the thus selected pixel in any direction of the four directions of up, down, left, and right showed a hard second phase, these two pixels were judged to be the same connected region. In the same way, it is successively judged if the pixels adjoining it in the up, down, left, and right directions are in a connected region to determine the range of a single connected region. The region having the greatest number of pixels in the connected region of the hard second phases determined in this way was specified as the "maximum connected region". The area ratio of the maximum connected region of the hard second phases with all of the hard second phase regions, i.e., the maximum connecting rate Rs of the hard second phases, was calculated from the ratio Rs=Sm/Ss of Area Sm of the maximum connected region found and the area Ss of the sum hard second phase regions.

The maximum connecting rate Rs (%) was calculated by the following formulas:

$$Rs=\{\text{area } Sm \text{ of maximum connected region of hard second phases/area } Ss \text{ of sum hard second phase regions}\}\times100$$

$$\text{Area } Ss \text{ of sum hard second phase regions}=\text{area } Sm \text{ of maximum connected region}+\text{total area } Sm' \text{ of nonmaximum connected region}$$

The two-dimensional isoperimetric constant K was calculated by the following formula. The perimeter Lm of the maximum connected region was measured in a structural image measured by the above FE-SEM.

$$\pi\cdot(Lm/2\pi)^2\cdot K=Sm$$

$$K=4\pi Sm/Lm^2$$

Lm: perimeter of maximum connected region of hard second phases (Measurement of Mechanical Properties)

The tensile strength, yield point, and uniform elongation were measured as follows: A JIS No. 5 test piece taken from a position of ¼ of the width direction of the cold rolled steel sheet in a direction perpendicular to the rolling direction (C direction) as the longitudinal direction was used for conducting a tensile test based on the provisions of JIS Z 2241 (2011) to find the yield point (0.2% yield strength) YS, tensile strength TS, and uniform elongation uEL. Further, the yield ratio YR was found using YR=(YS/TS)×100. When the tensile strength TS was 1180 MPa or more, the uniform elongation uEL was 10.0% or more (TS: 1180 to 1370 MPa) or 7.0% or more (TS: more than 1370 MPa), and the yield ratio YR was 60% or less, the steel sheet was evaluated as high strength cold rolled steel sheet excellent in workability and shape fixability.

The underlined numerical values in Tables 1 to 3 show values outside the scope of the present invention.

In Tables 2 to 3, Sample Nos. 1 to 3, No. 5, No. 9, No. 19, No. 22, No. 23, and Nos. 28 to 44 are steel sheets of the present inventions satisfying all of the conditions of the present invention.

In the invention examples, the chemical composition is satisfied and the structural fractions and particle size and morphologies are suitable, so cold rolled steel sheets with tensile strengths of 1180 MPa or more, with excellent uniform elongations, and with yield ratios YR of 60% or less are obtained.

Sample No. 26 has a chemical composition of the steel outside the scope prescribed in the present invention so an excellent 1180 MPa or more tensile strength cannot be obtained. Further, No. 27 does not satisfy the chemical composition of the steel prescribed in the present invention, so excellent uniform elongation and a low yield ratio are not obtained.

Sample No. 4, No. 6 to 8, No. 10 to 18, No. 20, No. 21, No. 24, and No. 25 have producing conditions outside the scope prescribed in the present invention, so a 1180 MPa or more tensile strength and excellent uniform elongation and low yield ratio cannot be simultaneously obtained.

TABLE 1

| | Chemical composition (units: mass %, balance Fe and impurities) | | | | | | | | Transformation points (° C.) | | | |
|---|---|---|---|---|---|---|---|---|---|---|---|---|
| Steel type | C | Si | Mn | sol. Al | P | S | N | Others | Ac1 | Ac3 | Ar3 | Ms |
| A | 0.18 | 1.40 | 2.10 | 0.030 | 0.010 | 0.001 | 0.003 | | 738 | 858 | 886 | 376 |
| B | 0.22 | 2.01 | 2.80 | 0.029 | 0.010 | 0.001 | 0.002 | | 739 | 867 | 888 | 332 |
| C | 0.27 | 2.20 | 2.90 | 0.031 | 0.008 | 0.001 | 0.003 | | 742 | 859 | 884 | 308 |
| D | 0.30 | 3.10 | 3.30 | 0.025 | 0.010 | 0.002 | 0.002 | B:0.001 | 762 | 897 | 908 | 268 |
| E | 0.26 | 1.20 | 1.20 | 0.025 | 0.010 | 0.001 | 0.002 | | 755 | 838 | 882 | 374 |
| F | 0.11 | 1.00 | 2.40 | 0.029 | 0.010 | 0.001 | 0.003 | | 717 | 850 | 875 | 403 |
| G | 0.21 | 0.40 | 2.10 | 0.020 | 0.012 | 0.003 | 0.003 | | 703 | 782 | 835 | 388 |
| H | 0.24 | 1.80 | 1.80 | 0.029 | 0.011 | 0.002 | 0.003 | B:0.001 | 760 | 870 | 899 | 353 |
| I | 0.18 | 1.20 | 2.10 | 0.025 | 0.010 | 0.001 | 0.002 | Nb:0.002 | 731 | 845 | 877 | 381 |
| J | 0.17 | 0.90 | 2.50 | 0.029 | 0.010 | 0.002 | 0.003 | Ti:0.010 | 710 | 819 | 856 | 381 |
| K | 0.20 | 1.60 | 2.40 | 0.030 | 0.011 | 0.001 | 0.003 | V:0.01 | 737 | 857 | 883 | 358 |
| L | 0.24 | 1.40 | 2.00 | 0.025 | 0.010 | 0.001 | 0.003 | Cr:0.40 | 740 | 839 | 876 | 357 |
| M | 0.19 | 2.10 | 1.80 | 0.020 | 0.012 | 0.001 | 0.003 | Mo:0.05 | 771 | 907 | 922 | 365 |
| N | 0.23 | 1.90 | 3.10 | 0.020 | 0.010 | 0.001 | 0.002 | Cu:0.01 | 727 | 849 | 874 | 324 |
| O | 0.24 | 2.11 | 2.01 | 0.030 | 0.010 | 0.001 | 0.003 | Co:0.10 | 765 | 885 | 907 | 342 |
| P | 0.19 | 1.00 | 2.20 | 0.029 | 0.010 | 0.001 | 0.003 | W:0.01 | 721 | 826 | 863 | 379 |
| Q | 0.28 | 3.10 | 1.80 | 0.020 | 0.012 | 0.003 | 0.003 | Ni:0.80 | 805 | 940 | 909 | 311 |
| R | 0.18 | 2.80 | 2.50 | 0.030 | 0.011 | 0.001 | 0.003 | Ca:0.006 | 776 | 939 | 939 | 336 |
| S | 0.28 | 1.20 | 2.70 | 0.021 | 0.013 | 0.001 | 0.002 | Mg:0.002 | 713 | 795 | 842 | 331 |
| T | 0.35 | 2.80 | 3.30 | 0.030 | 0.011 | 0.002 | 0.003 | REM:0.005 | 751 | 860 | 885 | 257 |
| U | 0.28 | 2.10 | 1.20 | 0.130 | 0.014 | 0.001 | 0.002 | Zr:0.002 | 786 | 890 | 918 | 347 |
| V | 0.30 | 1.20 | 2.90 | 0.580 | 0.010 | 0.002 | 0.003 | | 707 | 784 | 833 | 319 |
| W | 0.28 | 0.70 | 2.81 | 0.710 | 0.010 | 0.001 | 0.003 | | 692 | 760 | 817 | 339 |

TABLE 2

| | | | | | | Hot rolling step | | | | Tempering step | | |
|---|---|---|---|---|---|---|---|---|---|---|---|---|
| | | Transformation points | | | | Final stage rolling | Finish rolling end | Average cooling | Coiling | Tempering | | Tempering |
| Sample no. | Chemical comp. | Ac1 (° C.) | Ac3 (° C.) | Ar3 (° C.) | Ms (° C.) | reduction (%) | temp. (° C.) | rate (° C./s) | temp. (° C.) | temp. (° C.) | Time (h) | parameter ξ |
| 1 | A | 738 | 858 | 886 | 376 | 20 | 920 | 100 | RT | 500 | 1.0 | 15460 |
| 2 | B | 739 | 867 | 888 | 332 | 21 | 920 | 100 | 150 | 550 | 1.0 | 16460 |
| 3 | C | 742 | 859 | 884 | 308 | 17 | 900 | 80 | RT | 500 | 1.0 | 15460 |
| 4 | A | 738 | 858 | 886 | 376 | 10 | 920 | 100 | 80 | 530 | 1.0 | 16060 |
| 5 | D | 762 | 897 | 908 | 268 | 20 | 930 | 100 | 300 | 500 | 3.0 | 15829 |
| 6 | A | 738 | 858 | 886 | 376 | 19 | 870 | 100 | 150 | 500 | 1.0 | 15460 |
| 7 | J | 710 | 819 | 856 | 381 | 22 | 1000 | 100 | 100 | 500 | 1.5 | 15596 |
| 8 | A | 738 | 858 | 886 | 376 | 21 | 910 | 25 | 200 | 490 | 1.2 | 15320 |
| 9 | A | 738 | 858 | 886 | 376 | 20 | 910 | 100 | 385 | 500 | 1.0 | 15460 |
| 10 | B | 739 | 867 | 888 | 332 | 18 | 920 | 100 | 150 | 400 | 12.0 | 14186 |
| 11 | L | 740 | 839 | 876 | 357 | 21 | 915 | 100 | 100 | 630 | 0.5 | 17788 |
| 12 | B | 739 | 867 | 888 | 332 | 20 | 920 | 120 | 200 | 580 | 30.0 | 18320 |
| 13 | C | 742 | 859 | 884 | 308 | 20 | 920 | 100 | 120 | 500 | 1.0 | 15460 |
| 14 | C | 742 | 859 | 884 | 308 | 20 | 930 | 90 | RT | 500 | 1.0 | 15460 |
| 15 | A | 738 | 858 | 886 | 376 | 20 | 920 | 100 | RT | 500 | 1.0 | 15460 |
| 16 | C | 742 | 859 | 884 | 308 | 20 | 920 | 100 | 100 | 520 | 1.2 | 15923 |
| 17 | A | 738 | 858 | 886 | 376 | 20 | 920 | 100 | RT | 500 | 1.0 | 15460 |
| 18 | A | 738 | 858 | 886 | 376 | 20 | 920 | 70 | 600 | 500 | 2.0 | 15693 |
| 19 | B | 739 | 867 | 888 | 332 | 25 | 920 | 100 | RT | 500 | 3.0 | 15829 |

TABLE 2-continued

| | | | | | | | | | | | | |
|---|---|---|---|---|---|---|---|---|---|---|---|---|
| 20 | C | 742 | 859 | 884 | 308 | 22 | 900 | 120 | 250 | 510 | 2.0 | 15896 |
| 21 | C | 742 | 859 | 884 | 308 | 20 | 930 | 100 | 100 | 500 | 1.0 | 15460 |
| 22 | A | 738 | 858 | 886 | 376 | 17 | 930 | 100 | 200 | 500 | 1.5 | 15596 |
| 23 | E | 755 | 838 | 882 | 374 | 17 | 900 | 100 | 200 | 500 | 1.0 | 15460 |
| 24 | A | 738 | 858 | 886 | 376 | 21 | 920 | 120 | 200 | 500 | 3.0 | 15829 |
| 25 | E | 755 | 838 | 882 | 374 | 19 | 930 | 100 | RT | 500 | 1.0 | 15460 |
| 26 | F | 717 | 850 | 875 | 403 | 21 | 900 | 100 | RT | 520 | 1.0 | 15860 |
| 27 | G | 703 | 782 | 835 | 388 | 22 | 910 | 100 | 100 | 500 | 1.0 | 15460 |
| 28 | H | 760 | 870 | 899 | 353 | 25 | 920 | 60 | 300 | 550 | 0.5 | 16212 |
| 29 | I | 731 | 845 | 877 | 381 | 20 | 910 | 100 | 100 | 500 | 1.0 | 15460 |
| 30 | J | 710 | 819 | 856 | 381 | 17 | 920 | 110 | RT | 500 | 1.5 | 15596 |
| 31 | K | 737 | 857 | 883 | 358 | 21 | 920 | 100 | 120 | 500 | 1.0 | 15460 |
| 32 | L | 740 | 839 | 876 | 357 | 23 | 900 | 100 | 100 | 480 | 1.0 | 15060 |
| 33 | M | 771 | 907 | 922 | 365 | 19 | 930 | 100 | 120 | 510 | 1.0 | 15660 |
| 34 | N | 727 | 849 | 874 | 324 | 40 | 890 | 120 | RT | 520 | 1.0 | 15860 |
| 35 | O | 765 | 885 | 907 | 342 | 23 | 920 | 100 | 120 | 500 | 1.0 | 15460 |
| 36 | P | 721 | 826 | 863 | 379 | 33 | 900 | 100 | 120 | 500 | 1.0 | 15460 |
| 37 | Q | 805 | 940 | 909 | 311 | 18 | 920 | 100 | RT | 520 | 1.0 | 15860 |
| 38 | R | 776 | 939 | 939 | 336 | 22 | 940 | 120 | 100 | 500 | 1.2 | 15521 |
| 39 | S | 713 | 795 | 842 | 331 | 21 | 930 | 100 | 120 | 500 | 1.0 | 15460 |
| 40 | T | 751 | 860 | 885 | 257 | 30 | 920 | 100 | RT | 500 | 1.0 | 15460 |
| 41 | U | 786 | 890 | 918 | 347 | 19 | 940 | 100 | RT | 500 | 1.0 | 15460 |
| 42 | A | 738 | 858 | 886 | 376 | 17 | 920 | 100 | RT | 500 | 1.0 | 15460 |
| 43 | V | 707 | 784 | 833 | 319 | 17 | 890 | 90 | RT | 525 | 1.0 | 15960 |
| 44 | W | 692 | 760 | 817 | 339 | 18 | 900 | 90 | RT | 500 | 1.0 | 15460 |

| | Cold rolling step | Annealing step | | | | | Reheating step | | | |
|---|---|---|---|---|---|---|---|---|---|---|
| Sample no. | Rolling reduction (%) | Heating rate (° C./s) | Max. heating temp. (° C.) | Heating holding time (s) | Cooling rate (° C./s) | Cooling stop temp. (° C.) | Reheat temp. (° C.) | Reheat time (s) | Hot dip galvanization step | Remarks |
| 1 | 63 | 3.8 | 770 | 600 | 50 | RT | — | — | — | Inv. ex. |
| 2 | 55 | 3.9 | 800 | 600 | 50 | RT | — | — | — | Inv. ex. |
| 3 | 48 | 3.9 | 760 | 1000 | 50 | RT | — | — | — | Inv. ex. |
| 4 | 52 | 3.7 | 770 | 500 | 45 | 300 | — | — | — | Comp. ex. |
| 5 | 40 | 4.2 | 780 | 300 | 30 | 250 | — | — | — | Inv. ex. |
| 6 | 50 | 4.2 | 770 | 300 | 50 | 300 | — | — | — | Comp. ex. |
| 7 | 53 | 3.8 | 750 | 500 | 50 | 100 | — | — | — | Comp. ex. |
| 8 | 55 | 3.8 | 810 | 600 | 50 | 100 | — | — | — | Comp. ex. |
| 9 | 50 | 2.5 | 790 | 600 | 50 | 50 | — | — | — | Inv. ex. |
| 10 | 45 | 4.0 | 800 | 600 | 50 | 100 | — | — | — | Comp. ex. |
| 11 | 50 | 4.1 | 790 | 500 | 50 | 100 | — | — | — | Comp. ex. |
| 12 | 60 | 4.5 | 790 | 500 | 50 | 100 | — | — | — | Comp. ex. |
| 13 | 20 | 4.5 | 795 | 100 | 50 | 100 | — | — | — | Comp. ex. |
| 14 | 50 | 10.0 | 780 | 70 | 50 | 150 | — | — | — | Comp. ex. |
| 15 | 63 | 3.8 | 770 | 30 | 50 | 100 | — | — | — | Comp. ex. |
| 16 | 45 | 3.6 | 795 | 300 | 15 | 100 | — | — | — | Comp. ex. |
| 17 | 53 | 3.8 | 790 | 300 | 30 | 400 | — | — | — | Comp. ex. |
| 18 | 50 | 4.0 | 790 | 600 | 50 | 100 | — | — | — | Comp. ex. |
| 19 | 50 | 3.9 | 800 | 400 | 50 | RT | 300 | 300 | — | Inv. ex. |
| 20 | 55 | 3.6 | 780 | 150 | 40 | 100 | 500 | 200 | — | Comp. ex. |
| 21 | 45 | 4.0 | 775 | 300 | 40 | 150 | 400 | 700 | — | Comp. ex. |
| 22 | 50 | 4.5 | 800 | 600 | 40 | 350 | — | — | GI | Inv. ex. |
| 23 | 50 | 3.6 | 810 | 100 | 40 | 200 | — | — | — | Inv. ex. |
| 24 | 45 | 4.1 | 745 | 120 | 40 | 300 | — | — | — | Comp. ex. |
| 25 | 50 | 3.9 | 830 | 150 | 40 | 250 | — | — | — | Comp. ex. |
| 26 | 55 | 3.5 | 750 | 600 | 50 | 100 | — | — | — | Comp. ex. |
| 27 | 50 | 2.5 | 740 | 300 | 50 | 300 | — | — | — | Comp. ex. |
| 28 | 45 | 4.1 | 790 | 600 | 30 | RT | — | — | — | Inv. ex. |
| 29 | 50 | 3.9 | 780 | 300 | 50 | 300 | — | — | — | Inv. ex. |
| 30 | 50 | 4.2 | 770 | 600 | 50 | RT | — | — | — | Inv. ex. |
| 31 | 50 | 4.2 | 760 | 600 | 50 | RT | — | — | — | Inv. ex. |
| 32 | 50 | 4.1 | 780 | 400 | 50 | 100 | — | — | — | Inv. ex. |
| 33 | 55 | 3.8 | 820 | 600 | 50 | RT | — | — | — | Inv. ex. |
| 34 | 50 | 4.2 | 790 | 300 | 50 | 250 | 350 | 60 | — | Inv. ex. |
| 35 | 45 | 4.5 | 800 | 180 | 50 | RT | — | — | — | Inv. ex. |
| 36 | 50 | 3.6 | 750 | 300 | 45 | RT | — | — | — | Inv. ex. |
| 37 | 45 | 4.5 | 890 | 80 | 50 | 250 | — | — | — | Inv. ex. |
| 38 | 50 | 4.2 | 850 | 100 | 50 | RT | — | — | — | Inv. ex. |
| 39 | 50 | 4.1 | 760 | 300 | 50 | 100 | — | — | — | Inv. ex. |
| 40 | 60 | 4.3 | 800 | 300 | 55 | RT | — | — | — | Inv. ex. |
| 41 | 50 | 3.6 | 810 | 300 | 50 | RT | — | — | — | Inv. ex. |
| 42 | 55 | 4.5 | 810 | 400 | 40 | 320 | — | — | GA | Inv. ex. |
| 43 | 50 | 4.0 | 755 | 550 | 50 | RT | — | — | — | Inv. ex. |
| 44 | 55 | 4.0 | 720 | 500 | 50 | RT | — | — | — | Inv. ex. |

TABLE 3

| Sample no. | Chem. comp. | Metallic structure: Ferrite phase area ratio (%) | Hard second phase area ratio (%) | Remaining phase area ratio (%) | Average crystal grain size (μm) | Recrystallized ferrite fraction (%) | Hard second phase max. connecting rate (%) |
|---|---|---|---|---|---|---|---|
| 1 | A | 53 | 45 | 2 | 1.9 | 79 | 32 |
| 2 | B | 42 | 55 | 3 | 1.7 | 83 | 55 |
| 3 | C | 39 | 60 | 1 | 1.3 | 76 | 89 |
| 4 | A | 60 | 38 | 2 | 8.0 | 84 | 3 |
| 5 | D | 39 | 58 | 3 | 1.6 | 83 | 92 |
| 6 | A | 58 | 40 | 2 | 6.3 | 78 | 19 |
| 7 | J | 53 | 45 | 2 | 3.9 | 89 | 8 |
| 8 | A | 35 | 63 | 2 | 12.0 | 85 | 5 |
| 9 | A | 49 | 50 | 1 | 4.2 | 79 | 24 |
| 10 | B | 43 | 55 | 2 | 6.9 | 91 | 6 |
| 11 | L | 41 | 57 | 2 | 12.1 | 73 | 8 |
| 12 | B | 46 | 53 | 1 | 5.8 | 75 | 19 |
| 13 | C | 41 | 55 | 4 | 6.3 | 52 | 18 |
| 14 | C | 44 | 54 | 2 | 4.7 | 58 | 18 |
| 15 | A | 53 | 40 | 7 | 2.1 | 85 | 24 |
| 16 | C | 45 | 40 | 15 | 3.6 | 80 | 14 |
| 17 | A | 50 | 18 | 32 | 4.1 | 95 | 9 |
| 18 | A | 52 | 45 | 3 | 14.0 | 87 | 8 |
| 19 | B | 38 | 60 | 2 | 1.9 | 90 | 79 |
| 20 | C | 42 | 51 | 7 | 2.6 | 87 | 18 |
| 21 | C | 48 | 44 | 8 | 2.2 | 78 | 28 |
| 22 | A | 36 | 60 | 4 | 2.3 | 95 | 35 |
| 23 | E | 42 | 55 | 3 | 2.4 | 85 | 19 |
| 24 | A | 65 | 31 | 4 | 4.6 | 75 | 21 |
| 25 | E | 13 | 83 | 4 | 3.2 | 81 | 98 |
| 26 | F | 60 | 38 | 2 | 4.5 | 92 | 11 |
| 27 | G | 35 | 63 | 2 | 6.3 | 88 | 85 |
| 28 | H | 46 | 52 | 2 | 3.6 | 80 | 25 |
| 29 | I | 47 | 50 | 3 | 1.9 | 90 | 19 |
| 30 | J | 36 | 62 | 2 | 1.7 | 87 | 31 |
| 31 | K | 55 | 44 | 1 | 2.5 | 72 | 13 |
| 32 | L | 46 | 52 | 2 | 3.1 | 77 | 21 |
| 33 | M | 36 | 63 | 1 | 2.9 | 65 | 44 |
| 34 | N | 39 | 58 | 3 | 2.8 | 81 | 89 |
| 35 | O | 49 | 49 | 2 | 3.1 | 88 | 35 |
| 36 | P | 56 | 41 | 3 | 2.1 | 71 | 14 |
| 37 | Q | 41 | 57 | 2 | 2.4 | 80 | 54 |
| 38 | R | 38 | 59 | 3 | 3.2 | 80 | 73 |
| 39 | S | 50 | 49 | 1 | 3.1 | 78 | 56 |
| 40 | T | 40 | 58 | 2 | 2.1 | 80 | 98 |
| 41 | U | 36 | 61 | 3 | 1.9 | 95 | 98 |
| 42 | A | 37 | 59 | 4 | 2.4 | 92 | 41 |
| 43 | V | 48 | 50 | 2 | 1.8 | 79 | 79 |
| 44 | W | 40 | 59 | 1 | 2.1 | 75 | 77 |

| Sample no. | Metallic structure: Hard second phase 2D isoperimetric constant | Mechanical properties: Yield point YS (MPa) | Tensile strength TS (MPa) | Uniform elongation uEL (%) | Yield ratio YR (%) | Remarks |
|---|---|---|---|---|---|---|
| 1 | 0.06 | 594 | 1238 | 11.0 | 48 | Inv. ex. |
| 2 | 0.13 | 686 | 1491 | 8.7 | 46 | Inv. ex. |
| 3 | 0.04 | 759 | 1686 | 7.1 | 45 | Inv. ex. |
| 4 | 0.46 | 595 | 976 | 14.0 | 61 | Comp. ex. |
| 5 | 0.05 | 747 | 1778 | 7.0 | 42 | Inv. ex. |
| 6 | 0.35 | 833 | 1141 | 11.0 | 73 | Comp. ex. |
| 7 | 0.31 | 727 | 1101 | 10.1 | 66 | Comp. ex. |
| 8 | 0.15 | 690 | 1095 | 9.8 | 63 | Comp. ex. |
| 9 | 0.04 | 540 | 1201 | 12.0 | 45 | Inv. ex. |
| 10 | 0.28 | 811 | 1308 | 6.0 | 62 | Comp. ex. |
| 11 | 0.25 | 736 | 1098 | 14.0 | 67 | Comp. ex. |
| 12 | 0.23 | 715 | 1135 | 12.0 | 63 | Comp. ex. |
| 13 | 0.18 | 887 | 1431 | 6.2 | 62 | Comp. ex. |
| 14 | 0.63 | 1055 | 1551 | 5.9 | 68 | Comp. ex. |
| 15 | 0.05 | 607 | 1103 | 15.0 | 55 | Comp. ex. |
| 16 | 0.08 | 755 | 1218 | 8.6 | 62 | Comp. ex. |
| 17 | 0.41 | 961 | 1095 | 6.1 | 88 | Comp. ex. |
| 18 | 0.29 | 619 | 983 | 14.0 | 63 | Comp. ex. |
| 19 | 0.14 | 806 | 1390 | 9.0 | 58 | Inv. ex. |
| 20 | 0.09 | 1020 | 1416 | 10.1 | 72 | Comp. ex. |
| 21 | 0.19 | 909 | 1377 | 13.1 | 66 | Comp. ex. |

TABLE 3-continued

| | | | | | | |
|---|---|---|---|---|---|---|
| 22 | 0.09 | 730 | 1258 | 12.0 | 58 | Inv. ex. |
| 23 | 0.05 | 770 | 1539 | 7.2 | 50 | Inv. ex. |
| 24 | 0.24 | 681 | 1098 | 14.0 | 62 | Comp. ex. |
| 25 | 0.23 | 1229 | 1731 | 5.2 | 71 | Comp. ex. |
| 26 | 0.18 | 556 | 1011 | 16.0 | 55 | Comp. ex. |
| 27 | 0.23 | 953 | 1401 | 6.2 | 68 | Comp. ex. |
| 28 | 0.19 | 686 | 1399 | 8.2 | 49 | Inv. ex. |
| 29 | 0.08 | 681 | 1381 | 7.2 | 49 | Inv. ex. |
| 30 | 0.17 | 800 | 1403 | 7.3 | 57 | Inv. ex. |
| 31 | 0.18 | 700 | 1399 | 8.3 | 50 | Inv. ex. |
| 32 | 0.09 | 723 | 1315 | 10.6 | 55 | Inv. ex. |
| 33 | 0.07 | 585 | 1299 | 11.6 | 45 | Inv. ex. |
| 34 | 0.03 | 876 | 1511 | 9.8 | 58 | Inv. ex. |
| 35 | 0.16 | 697 | 1394 | 7.8 | 50 | Inv. ex. |
| 36 | 0.09 | 699 | 1295 | 12.5 | 54 | Inv. ex. |
| 37 | 0.07 | 721 | 1413 | 8.4 | 51 | Inv. ex. |
| 38 | 0.13 | 826 | 1501 | 7.2 | 55 | Inv. ex. |
| 39 | 0.19 | 689 | 1406 | 9.1 | 49 | Inv. ex. |
| 40 | 0.01 | 943 | 1779 | 8.2 | 53 | Inv. ex. |
| 41 | 0.03 | 836 | 1671 | 7.4 | 50 | Inv. ex. |
| 42 | 0.11 | 710 | 1196 | 10.4 | 59 | Inv. ex. |
| 43 | 0.07 | 771 | 1547 | 8.5 | 50 | Inv. ex. |
| 44 | 0.06 | 781 | 1699 | 8.7 | 46 | Inv. ex. |

INDUSTRIAL APPLICABILITY

According to the above aspects of the present invention, it is possible to obtain cold rolled steel sheet having a 1180 MPa or more tensile strength (maximum tensile strength), excellent in workability, and excellent in shape fixability. Therefore, the industrial applicability is high.

REFERENCE SIGNS LIST

1 maximum connected region
2 ferrite structure region
3 nonmaximum connected region

The invention claimed is:

1. A cold rolled steel sheet having a chemical composition comprising, by mass %, C: 0.15% or more and 0.40% or less,
Si: 0.50% or more and 4.00% or less,
Mn: 1.00% or more and 4.00% or less,
sol. Al: 0.001% or more and 2.000% or less,
P: 0.020% or less,
S: 0.020% or less,
N: 0.010% or less,
Ti: 0% or more and 0.200% or less,
Nb: 0% or more and 0.200% or less,
B: 0% or more and 0.010% or less,
V: 0% or more and 1.00% or less,
Cr: 0% or more and 1.00% or less,
Mo: 0% or more and 1.00% or less,
Cu: 0% or more and 1.00% or less,
Co: 0% or more and 1.00% or less,
W: 0% or more and 1.00% or less,
Ni: 0% or more and 1.00% or less,
Ca: 0% or more and 0.010% or less,
Mg: 0% or more and 0.010% or less,
REM: 0% or more and 0.010% or less,
Zr: 0% or more and 0.010% or less, and
balance: iron and impurities, and a metallic structure consisting of ferrite phases, hard second phases consisting of martensite phases and retained austenite phases, and remaining phases consisting of cementite phases and bainite phases, wherein an area ratio of the ferrite phases is 35% or more and 65% or less, an area ratio of the hard second phases is 35% or more and 65% or less, an area ratio of the remaining phases is 0% or more and 5% or less, 60% or more of the ferrite phases are recrystallized ferrite phases, an average crystal grain size defined by boundaries with differences in crystal orientations of 15 degrees or more is 5.0 μm or less, a maximum connecting rate of the hard second phases is 10% or more, and a two-dimensional isoperimetric constant of the hard second phases is 0.20 or less.

2. The cold rolled steel sheet according to claim 1, wherein the chemical composition comprises, by mass %, one or more selected from the group consisting of Ti: 0.001% or more and 0.200% or less,
Nb: 0.001% or more and 0.200% or less,
B: 0.0005% or more and 0.010% or less,
V: 0.005% or more and 1.00% or less,
Cr: 0.005% or more and 1.00% or less,
Mo: 0.005% or more and 1.00% or less,
Cu: 0.005% or more and 1.00% or less,
Co: 0.005% or more and 1.00% or less,
W: 0.005% or more and 1.00% or less,
Ni: 0.005% or more and 1.00% or less,
Ca: 0.0003% or more and 0.010% or less,
Mg: 0.0003% or more and 0.010% or less,
REM: 0.0003% or more and 0.010% or less, and
Zr: 0.0003% or more and 0.010% or less.

3. The cold rolled steel sheet according to claim 1, having a hot dip galvanized layer on the surface thereof.

4. The cold rolled steel sheet according to claim 1, having a hot dip galvannealed layer on the surface thereof.

5. A method for producing the cold rolled steel sheet according to claim 1, comprising:

a hot rolling step of rough rolling a slab having the chemical composition according to claim 1, then finish rolling it wherein a rolling reduction of a final stage of the finish rolling is 15% or more and 50% or less and an end temperature of the finish rolling is Ar3° C. or more and 950° C. or less, cooling it down to a coiling temperature of less than 400° C. by an average cooling rate of 50° C./s or more, and coiling it at the coiling temperature, a tempering step of tempering the hot rolled steel sheet in a temperature region of 450° C. or more and less than 600° C. under conditions of a tempering parameter ξ defined by following Formula 1 of 14000 to 18000, a cold rolling step of pickling the tempered steel sheet, then cold rolling it by a rolling reduction of 30% or more, and an annealing step of heating the cold rolled steel sheet in a temperature region of 500° C. to Ac1° C. by an average heating rate of 5.0° C./s or less up to a maximum heating temperature of (Ac1+10)° C. or more and (Ac3−10)° C. or less, holding it at the maximum heating temperature for 60 seconds or more, then cooling it in a temperature region of (Ac1−50)° C. to a cooling stop temperature by an average cooling rate of 20° C./s or more down to the cooling stop temperature of Ms° C. or less:

$$\xi=(T+273)\cdot[\log_{10}(t/3600)+20] \quad \text{Formula 1:}$$

T [° C.]: tempering temperature, t [s]: tempering time $$Ac1\ [°\ C.]=751-16\times[\%\ C]+35\times[\%\ Si]-28\times[\%\ Mn]$$

$$Ac3\ [°\ C.]=881-353\times[\%\ C]+65\times[\%\ Si]-24\times[\%\ Mn]$$

$$Ar3\ [°\ C.]=910-203\times[\%\ C]+44.7\times[\%\ Si]-24\times[\%\ Mn]-50\times[\%\ Ni]$$

$$Ms\ [°\ C.]=521-353\times[\%\ C]-22\times[\%\ Si]-24\times[\%\ Mn]$$

where % C, % Si, % Mn, and % Ni are contents [mass %] of C, Si, Mn, and Ni.

6. The method for producing the cold rolled steel sheet according to claim 5, further comprising cooling down to the cooling stop temperature of Ms° C. or less, then holding at a temperature of 200° C. or more and 450° C. or less for 60 seconds or more and 600 seconds or less.

7. The method for producing the cold rolled steel sheet according to claim 5, further comprising hot dip galvanization at a temperature of 430° C. or more after the annealing step to produce a cold rolled steel sheet having a hot dip galvanized layer on the surface thereof.

8. The method for producing the cold rolled steel sheet according to claim 5, further comprising hot dip galvanization at a temperature of 430° C. or more after the annealing step, then alloying treatment at 400° C. or more and 600° C. or less to produce a cold rolled steel sheet having a hot dip galvannealed layer on the surface thereof.

9. The method for producing the cold rolled steel sheet according to claim 6, further comprising hot dip galvanization at a temperature of 430° C. or more after the annealing step to produce a cold rolled steel sheet having a hot dip galvanized layer on the surface thereof.

10. The method for producing the cold rolled steel sheet according to claim 6, further comprising hot dip galvanization at a temperature of 430° C. or more after the annealing step, then alloying treatment at 400° C. or more and 600° C. or less to produce a cold rolled steel sheet having a hot dip galvannealed layer on the surface thereof.

* * * * *